US011229822B1

(12) United States Patent
Manula

(10) Patent No.: US 11,229,822 B1
(45) Date of Patent: Jan. 25, 2022

(54) FITNESS MACHINE

(71) Applicant: Fusion Fitness Designs, LLC, Port Orange, FL (US)

(72) Inventor: Cyril G. Manula, Port Orange, FL (US)

(73) Assignee: Fusion Fitness Designs, LLC, Port Orange, FL (US)

( * ) Notice: Subject to any disclaimer, the term of this patent is extended or adjusted under 35 U.S.C. 154(b) by 92 days.

(21) Appl. No.: 16/675,599

(22) Filed: Nov. 6, 2019

Related U.S. Application Data

(60) Provisional application No. 62/756,201, filed on Nov. 6, 2018.

(51) Int. Cl.

| | |
|---|---|
| ***A63B 23/035*** | (2006.01) |
| ***A63B 21/00*** | (2006.01) |
| ***A63B 21/062*** | (2006.01) |
| ***A63B 23/12*** | (2006.01) |

(52) U.S. Cl.
CPC .... *A63B 23/03541* (2013.01); *A63B 21/0628* (2015.10); *A63B 21/4035* (2015.10); *A63B 21/4047* (2015.10); *A63B 23/1209* (2013.01)

(58) Field of Classification Search
CPC ..... A63B 23/03541; A63B 23/1209; A63B 21/4035; A63B 21/0628; A63B 21/4047; A63B 23/00; A63B 23/035–03541; A63B 23/12; A63B 2023/0411; A63B 22/0002–0007; A63B 22/0012
See application file for complete search history.

(56) References Cited

U.S. PATENT DOCUMENTS

| | | | | |
|---|---|---|---|---|
| 4,286,782 | A * | 9/1981 | Fuhrhop | A63B 21/078 482/103 |
| 4,691,916 | A | 9/1987 | Voris | |
| 5,181,896 | A | 1/1993 | Jones | |
| D348,495 | S | 7/1994 | McCoy | |
| 5,437,589 | A | 8/1995 | Habing | |
| RE35,470 | E | 3/1997 | Jones | |
| 5,667,464 | A * | 9/1997 | Simonson | A63B 23/1254 482/134 |
| 5,688,216 | A * | 11/1997 | Mauriello | A63B 21/154 482/101 |
| 5,788,614 | A * | 8/1998 | Simonson | A63B 23/1254 482/134 |
| 5,803,882 | A | 9/1998 | Habing et al. | |
| 6,482,139 | B1 * | 11/2002 | Haag | A63B 21/0552 482/121 |
| 6,605,023 | B1 * | 8/2003 | Mobley | A63B 21/078 482/142 |

(Continued)

*Primary Examiner* — Andrew S Lo
(74) *Attorney, Agent, or Firm* — Brian S. Steinberger; Hilary F. Steinberger; Law Offices of Brian S. Steinberger, P.A.

(57) ABSTRACT

Systems, devices, and methods for a master press having independent press arms attached to a carriage that allows for the press arms and the carriage to be adjustable to different heights in order to perform various exercises. Additionally, a bench with an adjustable back and seat can be used to allow for varying exercises to be performed based on the height of the carriage system and adjustment of the bench. The systems, devices and methods can be used with or without a bench further increasing the functionality of the systems, devices and methods.

17 Claims, 22 Drawing Sheets

(56) References Cited

U.S. PATENT DOCUMENTS

| | | | | |
|---|---|---|---|---|
| 6,905,446 | B2 * | 6/2005 | Greenland | A63B 21/06 482/100 |
| 7,070,546 | B1 * | 7/2006 | Grasso | A63B 21/072 482/103 |
| 10,010,740 | B2 * | 7/2018 | Hockridge | A63B 21/4047 |
| D898,137 | S * | 10/2020 | Carmichael | D21/686 |
| 2005/0032614 | A1 * | 2/2005 | Keiser | A63B 21/4029 482/142 |
| 2006/0035772 | A1 * | 2/2006 | Golesh | A63B 21/4031 482/142 |
| 2007/0155596 | A1 * | 7/2007 | Rogers | A63B 21/4047 482/97 |
| 2009/0098986 | A1 * | 4/2009 | Quinn | A63B 23/0355 482/100 |
| 2011/0039665 | A1 * | 2/2011 | Dibble | A63B 21/4031 482/92 |
| 2013/0296146 | A1 * | 11/2013 | Staten | A63B 21/00069 482/120 |
| 2014/0213414 | A1 * | 7/2014 | Balandis | G10L 15/22 482/5 |
| 2015/0016919 | A1 * | 1/2015 | Tambornino | F16B 35/06 411/366.1 |
| 2015/0094193 | A1 * | 4/2015 | Lyszczarz | A63B 21/4047 482/38 |
| 2018/0021614 | A1 * | 1/2018 | Taft | A63B 21/169 482/5 |
| 2019/0240521 | A1 * | 8/2019 | Staten | A63B 17/04 |
| 2019/0275363 | A1 * | 9/2019 | Jones | A63B 21/0615 |

* cited by examiner

FITNESS MACHINE

RELATED APPLICATION

This application claims the benefit of priority to U.S. Provisional Patent Application Ser. No. 62/756,201 filed Nov. 6, 2018, which is incorporated by reference in its entirety.

FIELD OF INVENTION

This invention relates to fitness machines, and in particular to systems, devices, and methods for a master press having independent inwardly converging press arms that can support free weights attached to a carriage that allows for the press arms and the carriage to be adjustable to different heights in order to perform various exercises, with or without a bench with an adjustable back and seat to allow for varying exercises to be performed based on the height of the carriage system and adjustment of the bench.

BACKGROUND AND PRIOR ART

Weight pressing machines have been used over the years where a user can either sit or be positioned between two press arms, where various weights can be added or removed. The press arms can be pushed upward and downward. Generally, a bench or seat is used that is mounted to the machine. However, there are problems with these existing machines. See for example, U.S. Pat. No. 4,691,916 to Voris; U.S. Pat. No. 5,181,896 to Jones and Des. 348,495 to McCory, which are each incorporated by reference in their entirety.

To date the converging arms of plate loaded equipment could not be adjusted to perform varying exercises and were at a fixed position. In addition to the arms being in a non-adjustable fixed position the seat is also bolted into the machine in a fixed position. This allows for no exercise variation for plate loaded exercise equipment. Thus, the need exists for solutions to the above problems with the prior art.

Thus, the need exists for solutions to the above problems with the prior art.

SUMMARY OF THE INVENTION

A primary objective of the present invention is to provide systems, devices, and methods for a master press having independent converging press arms attached to an adjustable carriage that allows for the press arms and the carriage to be adjustable to different heights in order to perform various exercises.

A secondary objective of the present invention is to provide systems, devices, and methods for a master press having independent converging press arms attached to an adjustable carriage and a bench with an adjustable back and seat to allow for varying exercises to be performed based on the height of the carriage system and adjustment of the bench.

A third objective of the present invention is to provide systems, devices, and methods for a master press having independent converging press arms attached to an adjustable carriage, with the ability to limit the range of motion of the desired exercise being performed.

A fourth objective of the present invention is to provide systems, devices, and methods for a master press having independent converging press arms attached to an adjustable carriage, where the depth of the exercise movements can be controlled by adjusting the carriage to limited motions of the desired exercise.

A fifth objective of the present invention is to provide systems, devices, and methods for a master press having independent converging press arms attached to an adjustable carriage, which helps in injury prevention, and/or injury rehabilitation.

A sixth objective of the present invention is to provide systems, devices, and methods for a master press having independent converging press arms attached to an adjustable carriage, which allows for doing partial repetitions to help gain additional strength before transitioning into full ranges of motion.

A seventh objective of the present invention is to provide systems, devices and methods for a master press having independent converging press arms attached to an adjustable carriage, which maximizes the number of exercises that can be performed within a fixed amount of floor space.

A preferred embodiment a weight press exercise system can include a frame having a front side and a rear side, a first pair of vertical members attached to the frame, adjacent to the front side of the frame, each of the front vertical members being parallel to each another, each of the front vertical members having an upper end and a lower end, a carriage for sliding up and down on the front pair of vertical members, a pair of spaced apart pivotal arms, each having an inner end for being pivotally attached to the carriage, and a grip adjacent an outer end of each of the arms, a weight support post adjacent each outer end of the pivotal arms, each weight support post for allowing different amounts of weights to be positioned thereon, and an adjustable mount for prepositioning the carriage to be at different fixed height levels between the lower end and the upper end of the vertical members, wherein the grips on the horizontal arms are adapted to be gripped by a user positioned between the pivotal arms in order to push up and down to perform exercises based on different ranges of motion of the carriage based on the initial fixed position of the carriage.

The pivotal arms can have an initial horizontal position. The pivotal arms can converge together when moved upward. The pivotal arms can be independently moveable from one another.

The grip on each of the arms can extend inward toward each other. The weight support post on each of the arms can extend outward from the converging arms.

The weight press exercise system can further include a center post between the front pair of posts, and a fastening member for attaching the carriage to the center post.

The weight press exercise system can further include an adjustable bench not attached to the front side of the frame, the adjustable bench being adjustable to different positions spaced from the frame. The adjustable bench can include an adjustable seat portion, and an adjustable back portion attached to the adjustable seat portion. The adjustable bench can include an inverted L-shape stand, on which the seat portion and the back portion are located. The bench can include a plurality of parallel grooves on the inverted L-shaped stand, and pivotal arms extending below the seat portion and the back portion for allowing the adjustable bench to be moveable between different spacing differences from the front of the frame.

The adjustable mount can include a vertical height adjustment post having a plurality of vertically spaced apart openings, and a pin for locking the carriage to a selected one of the vertically spaced apart openings on the vertical post.

The weight press exercise system can include a pair of vertical posts adjacent to the rear side of the frame, each of the vertical posts having a plurality of side extending posts, wherein the side supporting posts are useful to support and store free weights thereon.

The weight press exercise system can include a pulley on top of the frame, a counter-weight; and a flexible line having a first end attached to the carriage and a second end passing on the pulley and attached to the counter-weight, wherein the counter-weight allows for the carriage to be easily positioned to a selected vertical height position. The flexible line can be a flexible belt.

The weight press exercise system can include a pair of vertical guide tubes attached to the frame, wherein side holes in the counter-weight allow for the counter-weight to slide up and down when the carriage is being positioned to the selected vertical height position.

The weight press exercise system can include a bearing assembly attached to the carriage for allowing the carriage to slide up and down on the front pair of vertical members.

The bearing assembly can include front side bearings for allowing the carriage to ride up and down on a front side of each of the vertical members, rear side bearings for allowing the carriage to ride up and down on a rear side of each of the vertical members, left side bearings for allowing the carriage to ride up and down on a left side of each of the vertical members, and a right side bearings for allowing the carriage to ride up and down on a right side of each of the vertical members.

The bearing assembly can include rotatable wheels on axles for allowing the carriage to ride up and down on each of the vertical members.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

DESCRIPTION OF THE PREFERRED EMBODIMENTS

Figure 1:
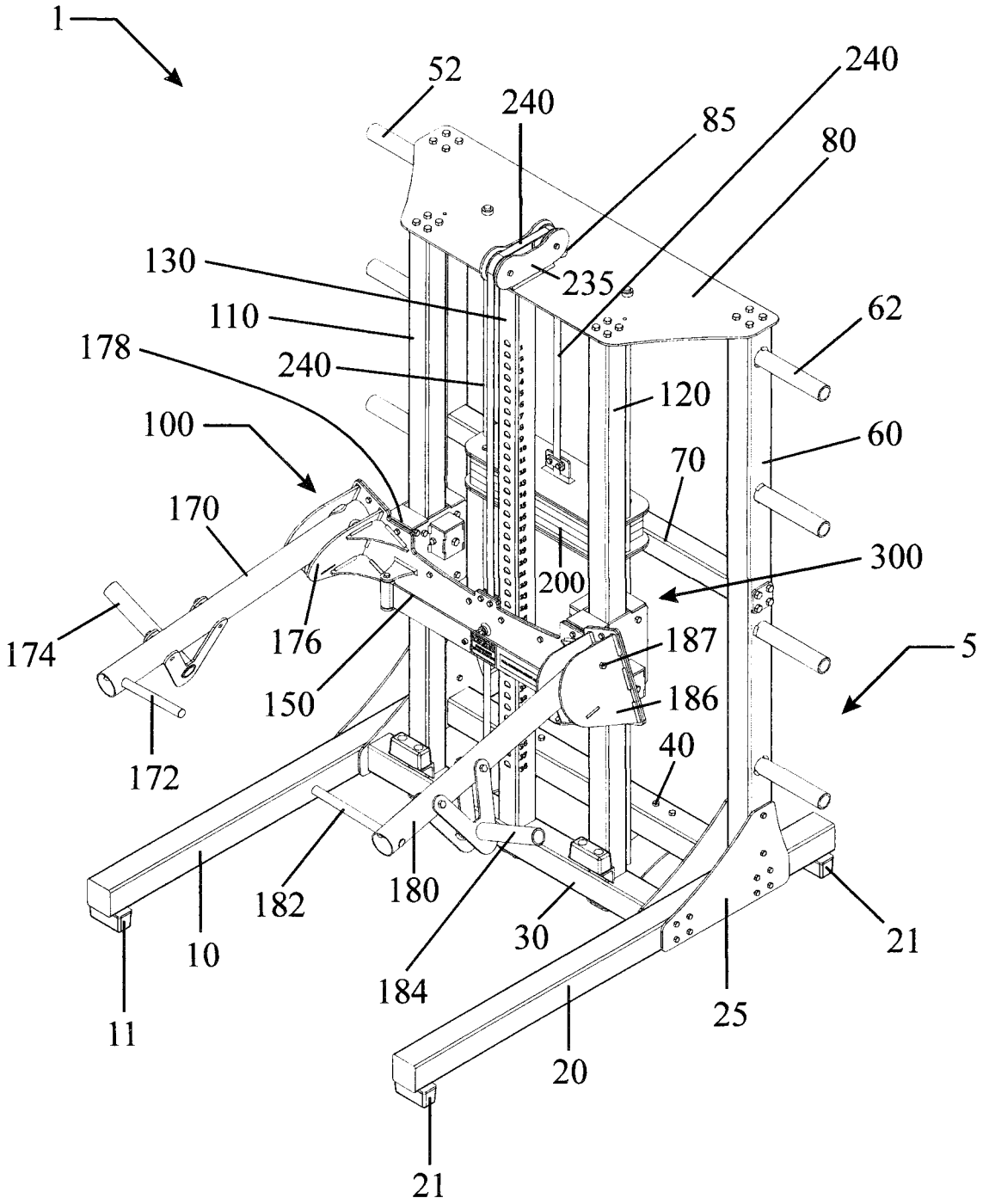
FIG. 1 is an upper front right perspective view of the fitness machine with height adjustable converging arms.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described

1 Fitness machine
5 main frame
10 left leg
11 end footers (rubber feet)
15 left triangular bracket
20 right leg
21 end footers (rubber feet)
25 right triangular bracket
30 bottom front horizontal frame tube
35 cross braces for horizontal frame tubes 30, 40
40 bottom rear horizontal frame tube

Figure 2:
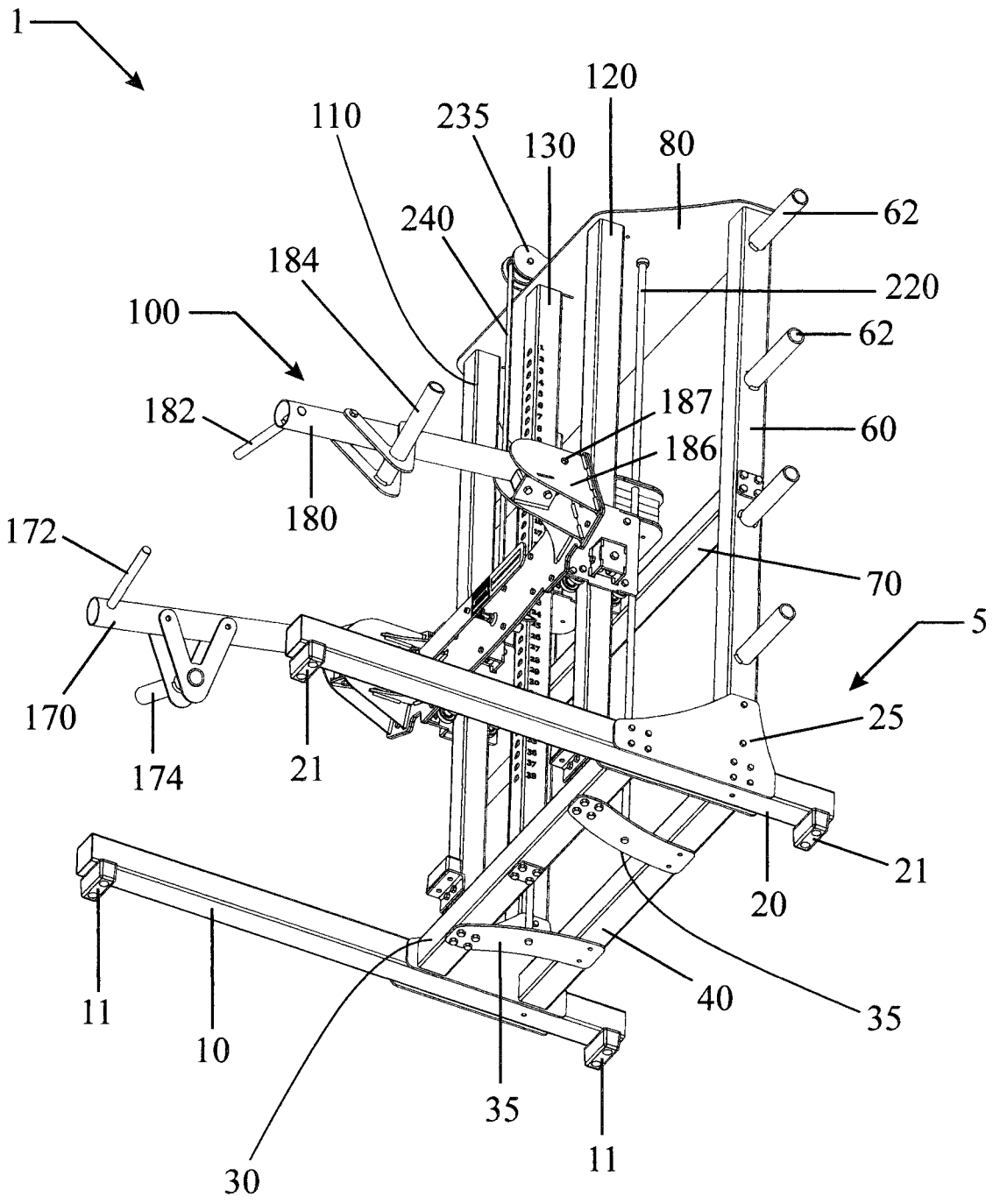
FIG. 2 is a lower front right perspective view of the fitness machine of FIG. 1.
Figure 3:
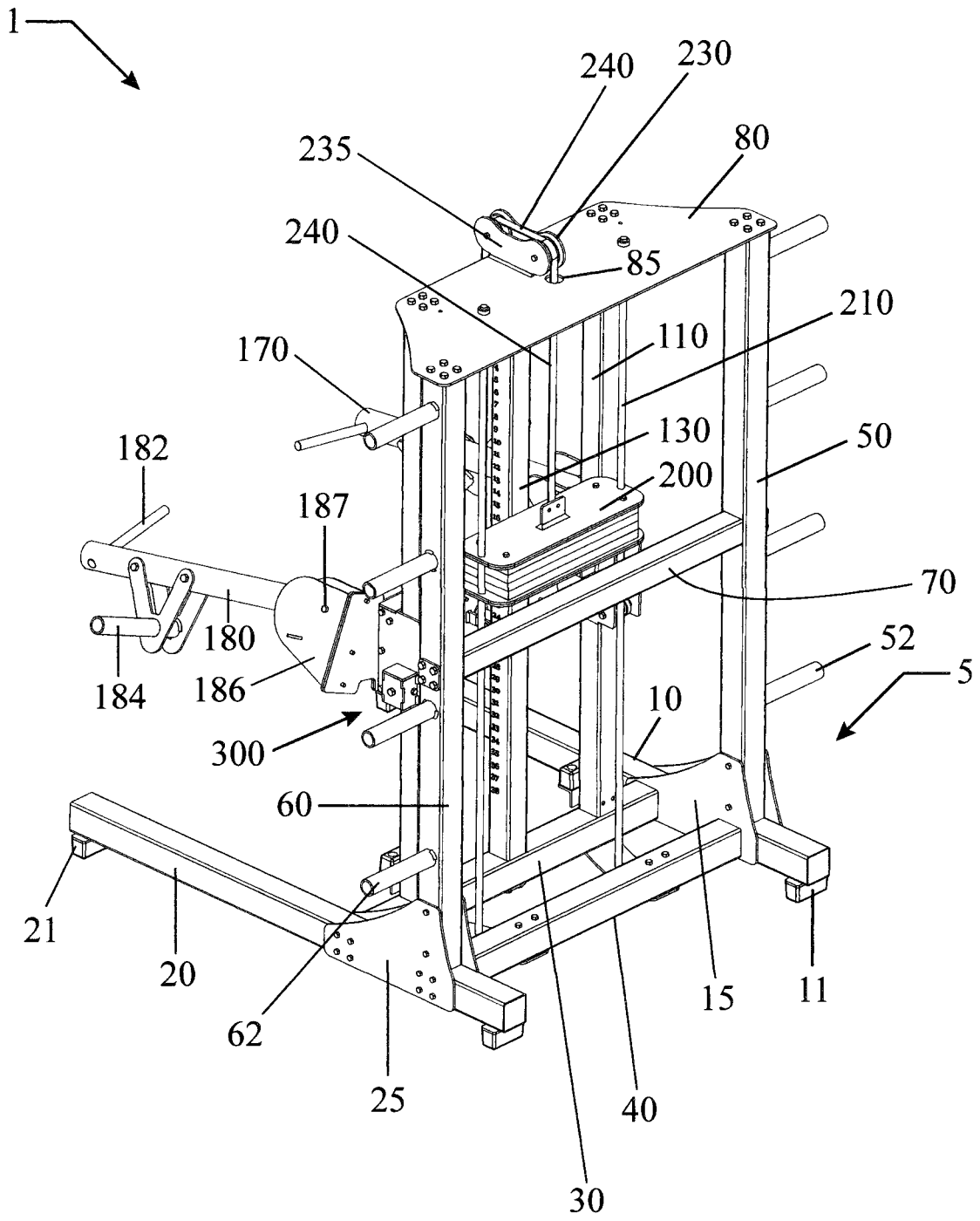
FIG. 3 is an upper rear left perspective view of the fitness machine of FIG. 1.
Figure 4:
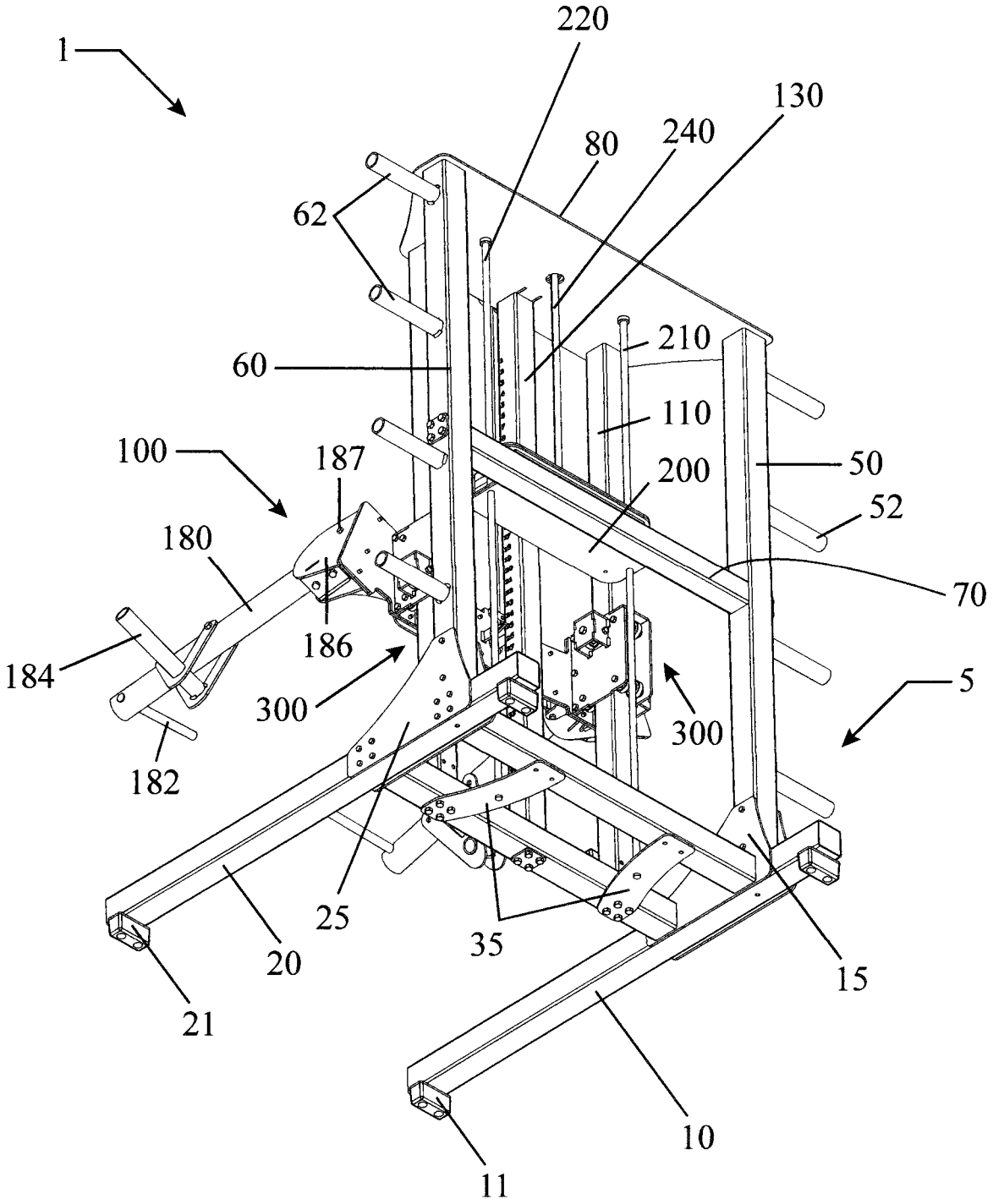
FIG. 4 is a lower rear left perspective view of the fitness machine of FIG. 1.

50 Rear left vertical frame tube
52 left weight plate posts
60 rear right vertical frame tube
62 right weight plate posts
70 rear middle horizontal frame tube
80 top plate
85 through-hole in top plate behind pulley bracket
100 moveable carriage and guide tube assembly
110 left vertical carriage guide tube
120 right vertical carriage guide tube
130 vertical height selector tube
135 selector holes for pin 138
138 lathing spring loaded pop pin for holding carriage to height selector tube 130
150 main carriage bracket
170 left converging pivotal arm
172 left inwardly facing grip
174 left outwardly extending post for weights
176 left arm holder pivot bracket
177 left arm bearing system (left pivot pin)
178 left front cover flange for left bearing box (300)
180 right converging pivotal arm
182 right inwardly facing grip
184 right outwardly extending post for weights
186 right arm holder pivot bracket
187 right arm bearing system (right pivot pin)
188 right front cover flange for right bearing box (300)
200 counter-weight
201 left guide rod hole(s) in counter-weight
203 right guide rod hole(s) in counter-weight
210 left counter-weight guide rod
220 right counterweight guide rod
230 pulley wheels
235 pulley bracket
237 pulley pins
240 flexible line, such as Kevlar belt
300 bearing box 2 (left bearing box, right bearing box)
310 left wall panel
320 right wall panel
330 top pair of bearings
332 first wheel
335 shaft
336 second wheel
340 bottom pair of bearings
342 first wheel
345 shaft
346 second wheel
350 side bearing box extending from left wall panel 310
351 hole
352 securing bolt
353 bolt stem axis
360 side bearings in side bearing box
365 side bearing shaft
370 side bearing box extending from right wall panel 320
371 hole
372 securing bolt
373 bolt stem axis
380 side bearings in right side box
385 side bearing shaft
400 bench
410 bench back
420 bench seat
430 Inverted L shaped bench frame
500 free weights
510, 520, 530, 540, 550 different size free weights FIG. 1 is an upper front right perspective view of the fitness machine 1 with height adjustable upwardly pivoting converging arms 170, 180. FIG. 2 is a lower front right perspective view of the fitness machine 1 of FIG. 1. FIG. 3 is an upper rear left perspective view of the fitness machine 1 of FIG. 1. FIG. 4 is a lower rear left perspective view of the fitness machine 1 of FIG. 1.

Figure 5:
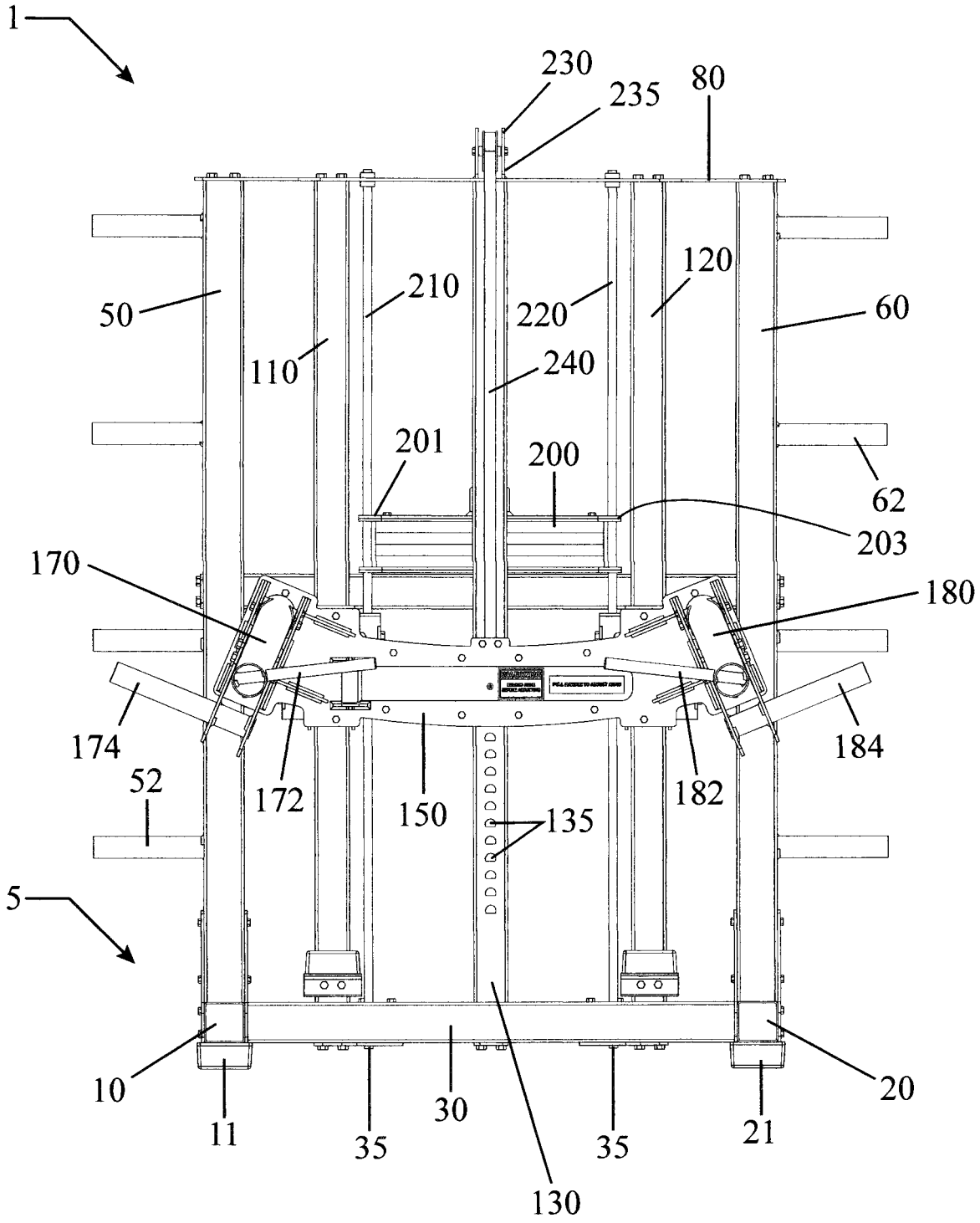
FIG. 5 is a front view of the fitness machine of FIG. 1.
Figure 6:
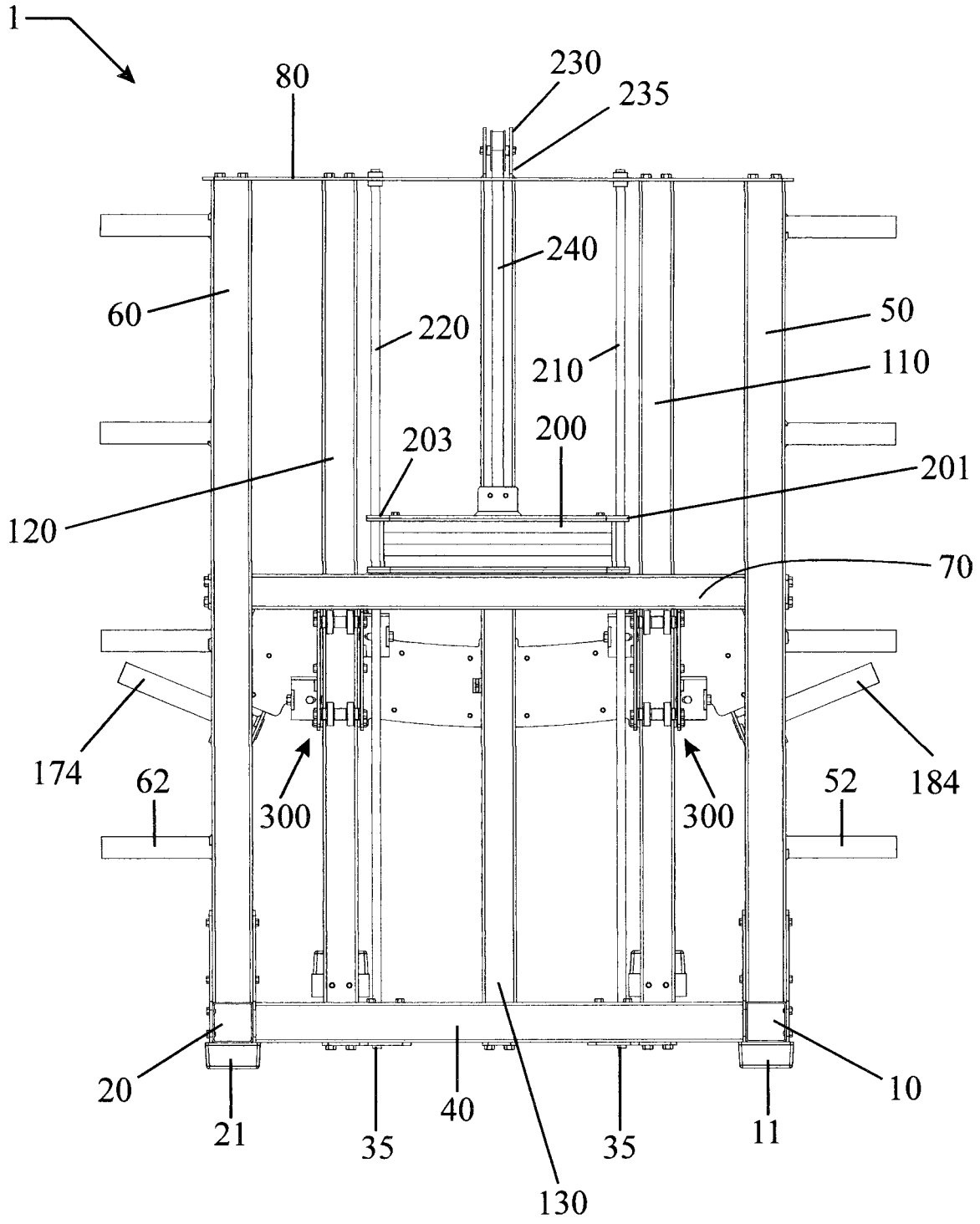
FIG. 6 is a back view of the fitness machine of FIG. 1.
Figure 7:
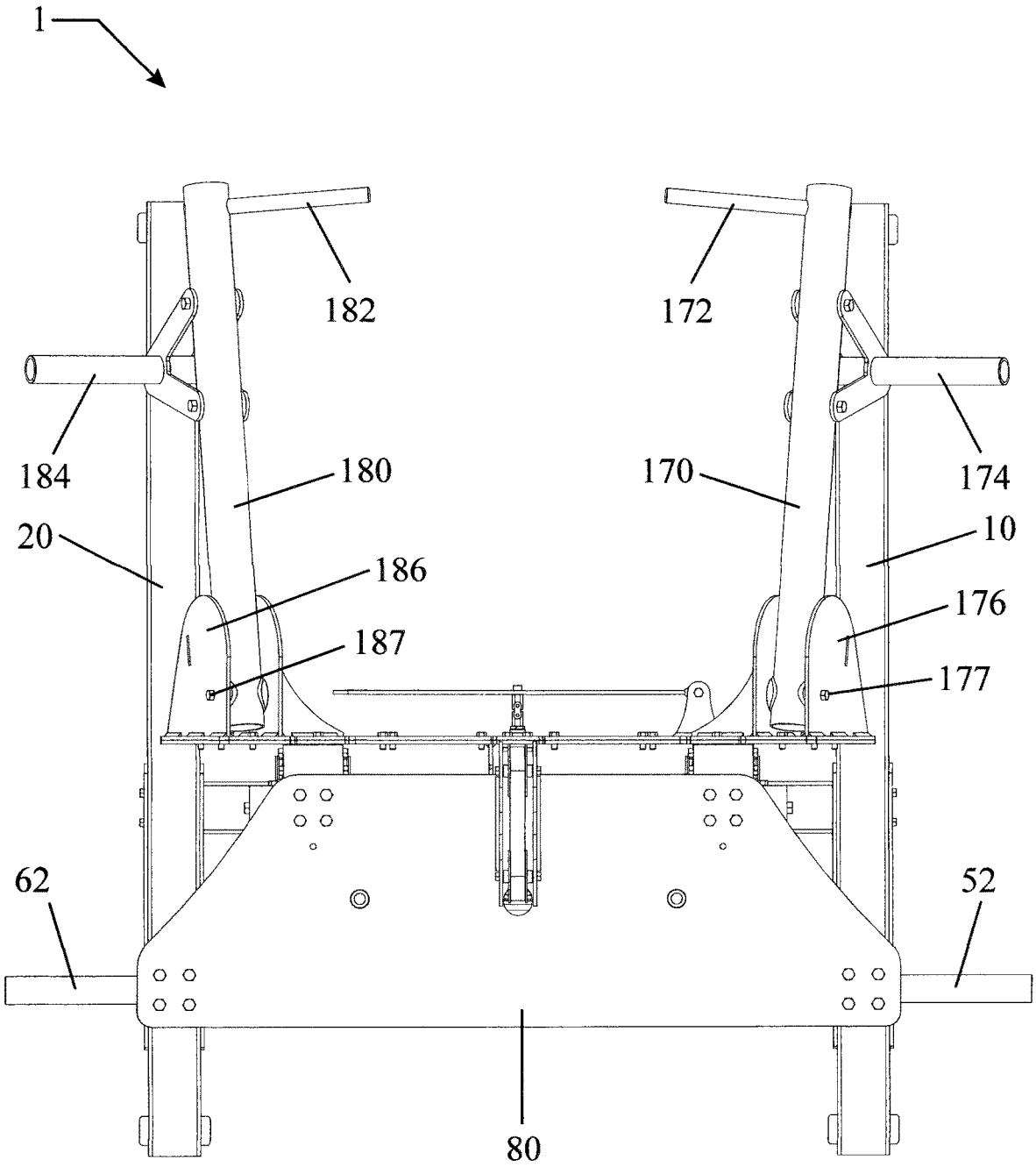
FIG. 7 is a top view of the fitness machine of FIG. 1.
Figure 8:
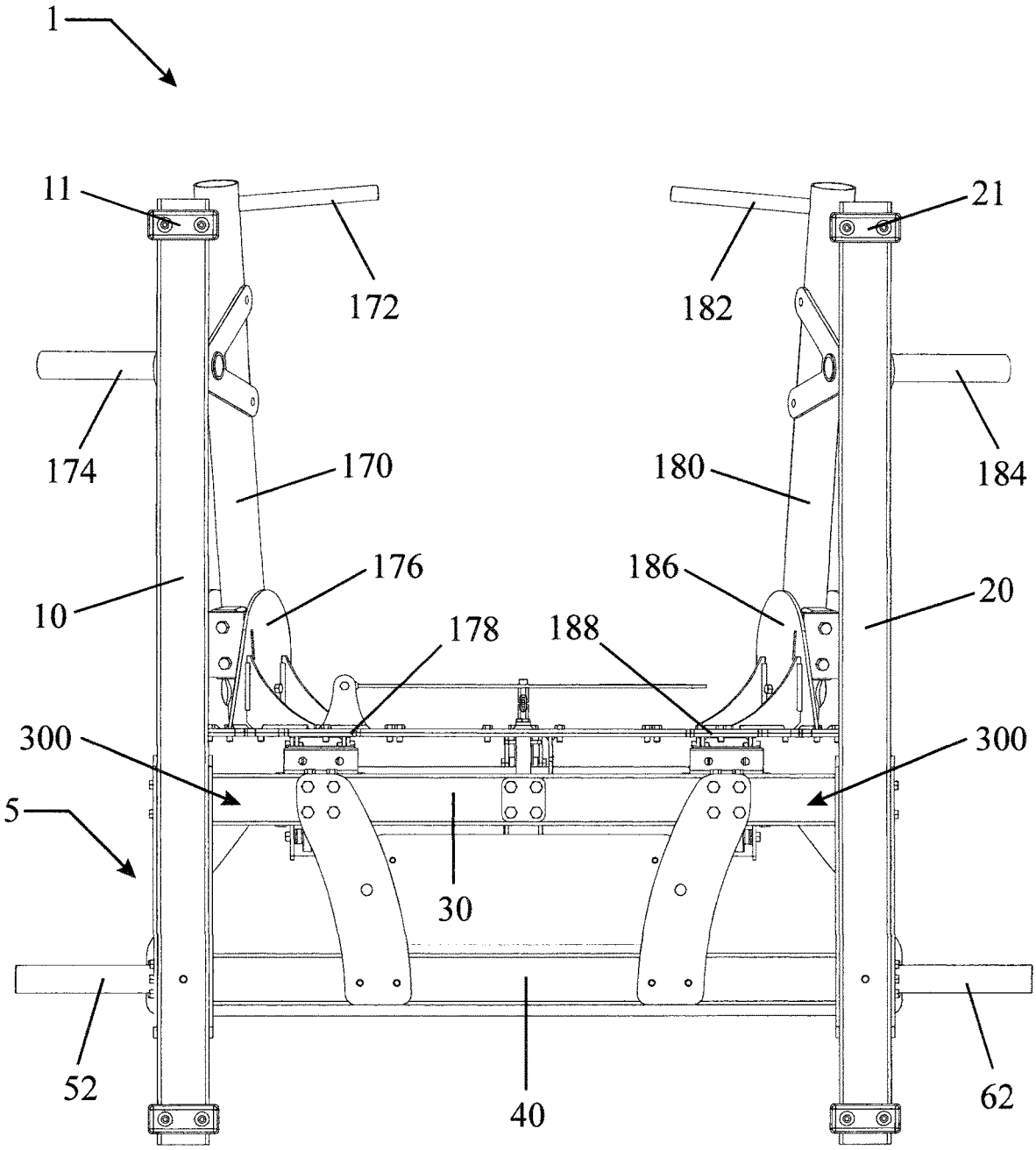
FIG. 8 is a bottom view of the fitness machine of FIG. 1.
Figure 9:
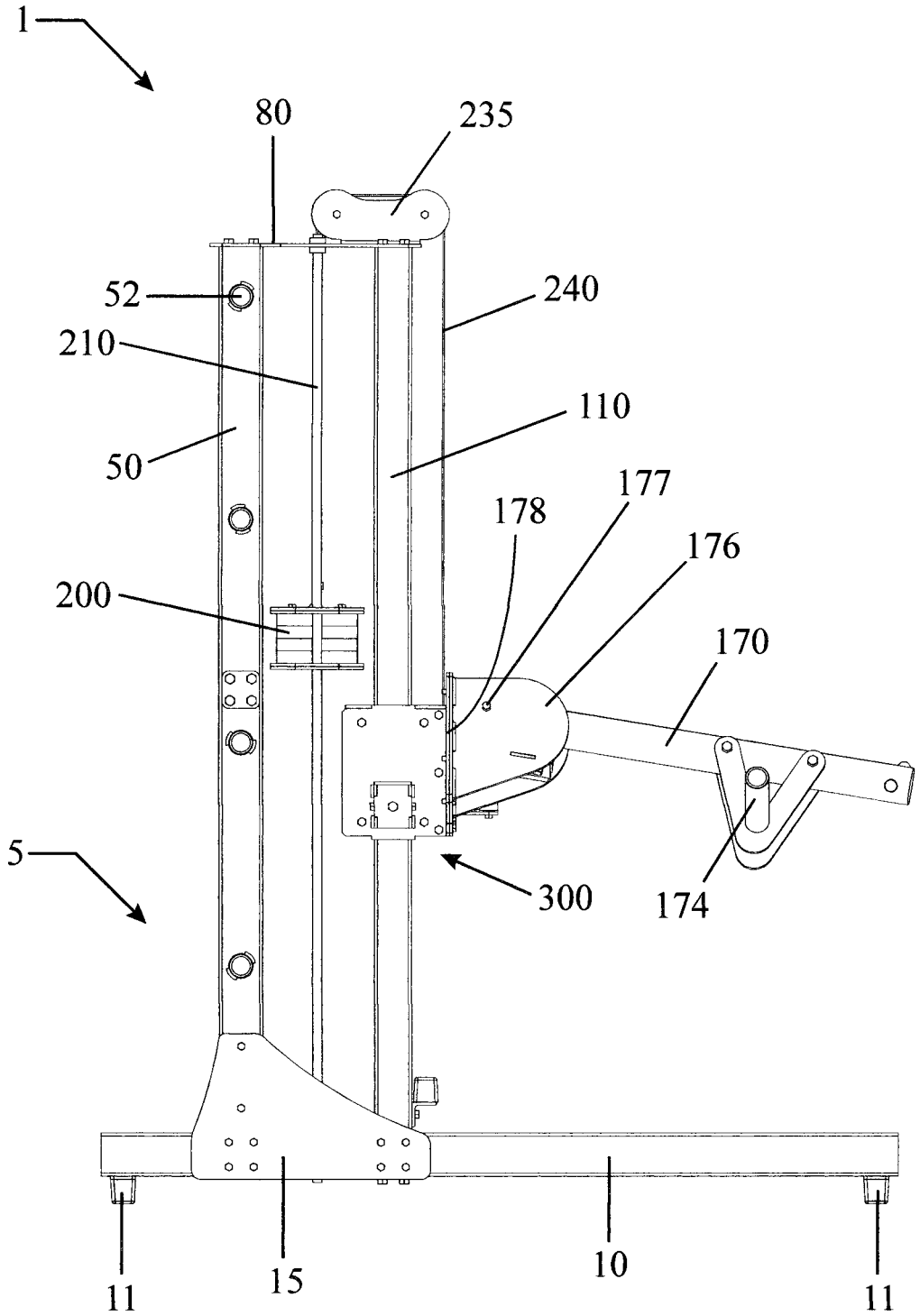
FIG. 9 is a left view of the fitness machine of FIG. 1.
Figure 10:
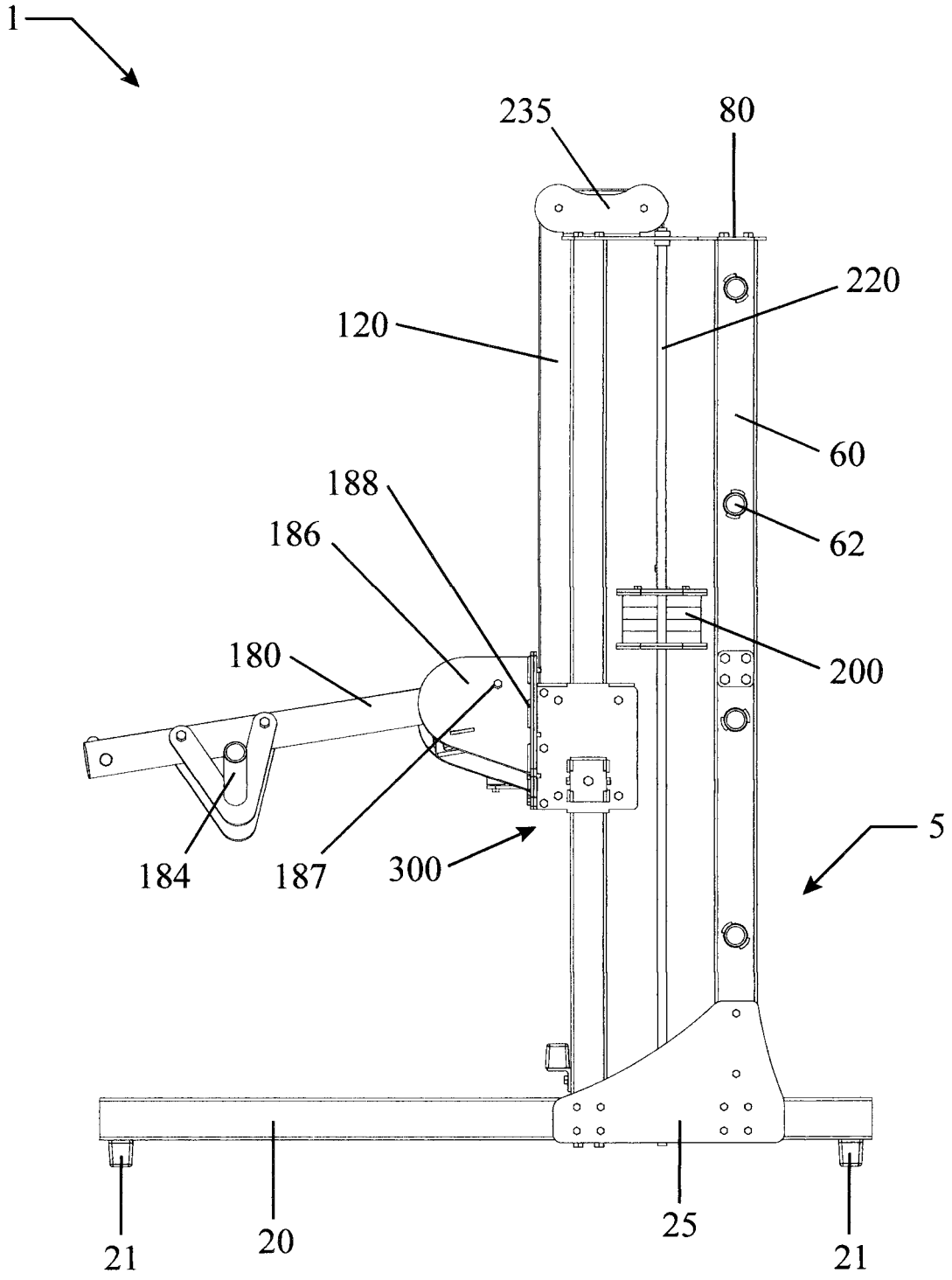
FIG. 10 is a right view of the fitness machine of FIG. 1.

FIG. 5 is a front view of the fitness machine 1 of FIG. 1. FIG. 6 is a back view of the fitness machine 1 of FIG. 1. FIG. 7 is a top view of the fitness machine 1 of FIG. 1. FIG. 8 is a bottom view of the fitness machine 1 of FIG. 1. FIG. 9 is a left side view of the fitness machine 1 of FIG. 1. FIG. 10 is a right side view of the fitness machine 1 of FIG. 1.

Referring to FIGS. 1-10, the fitness machine can include a main frame 5 having a left side horizontal leg 10 having end footers 11 that can be made from rubber, and the like, and a right side horizontal leg 20 having end footers 21 that can be made from rubber, and the like. Left leg 10 and right leg 20 can be spaced apart in a fixed parallel orientation by being fixably attached to ends of parallel bottom front horizontal frame tube 30 and bottom rear horizontal frame tube 40. Frame tubes 30, 40 can be stabilized and fixed apart from one another by one or more cross-braces 35.

The frame 5 can further include a left triangular bracket 15 fixably attached to a rear portion of the left horizontal leg 10, with a rear left vertical frame tube 50 extending upward therefrom, and a right triangular bracket 25 fixably attached to a rear portion of the right horizontal leg 20 with a rear right vertical frame tube 60 extending upward therefrom. A rear middle horizontal frame tube 70 can have ends fixably attached to inner side portions of rear left vertical frame tube 50 and rear right vertical frame tube 60 to function as an additional brace.

Extending outward from the rear left vertical frame tube 50 can be vertically spaced apart left weight plate posts 52, which can store weights thereon. Similarly extending outward from the rear right vertical frame tube 60 can be vertically spaced apart right weight plate posts 62, which can also be used to store weights thereon.

Referring to FIGS. 1-10, the main frame 5 can also include a pair of vertically oriented left and right vertical carriage guide tubes 110, 120. Extending upward from bottom front horizontal frame tube 30 can be a left vertical carriage guide tube 110, and a right vertical carriage guide tube 120. The bottom of the guide tubes 110, 120 can be fixably attached to top portions of the bottom front horizontal frame tube 30.

Spaced mid-way between the vertical carriage guide tubes 110, 120 can be a vertical height selector tube 130 with a bottom end fixably attached to another top portion of the bottom front horizontal frame tube 30. Spaced along a front of the vertical height selector tube 130 can be a vertical series of selector holes 135 which will be described later for locating the moveable carriage assembly 100 thereon.

The main frame 5 can include a top plate 80 that is fixably attached to the tops of left vertical carriage guide tube 110, right vertical carriage guide tube 120, vertical height selector tube 130, rear left vertical frame tube 50 and rear right vertical frame tube 60.

Figure 11:
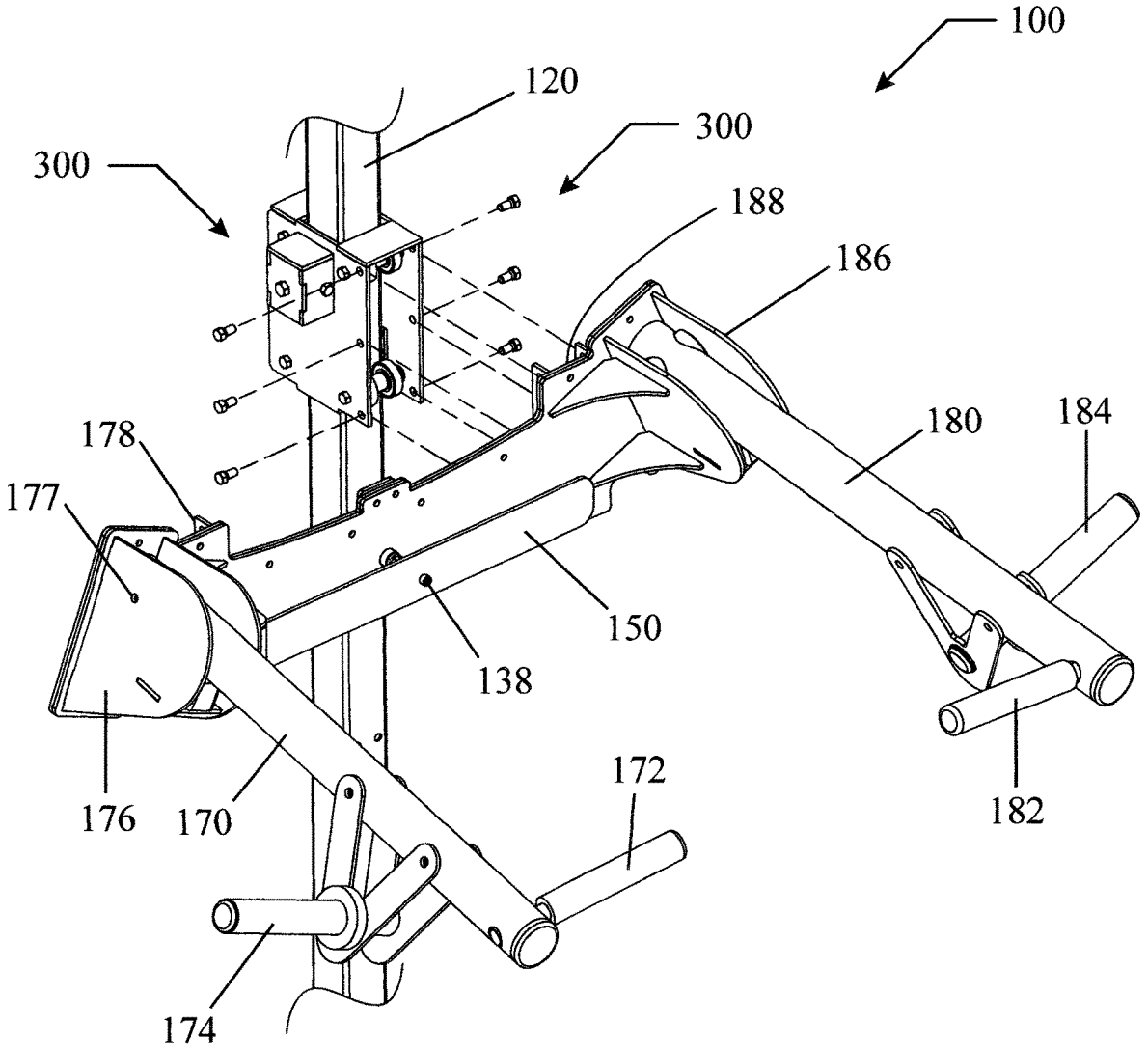
FIG. 11 is an enlarged exploded perspective view of the height adjustable carriage with converging arms.

FIG. 11 is an enlarged exploded perspective view of the height adjustable carriage 100 with converging arms 170, 180.

Figure 12:
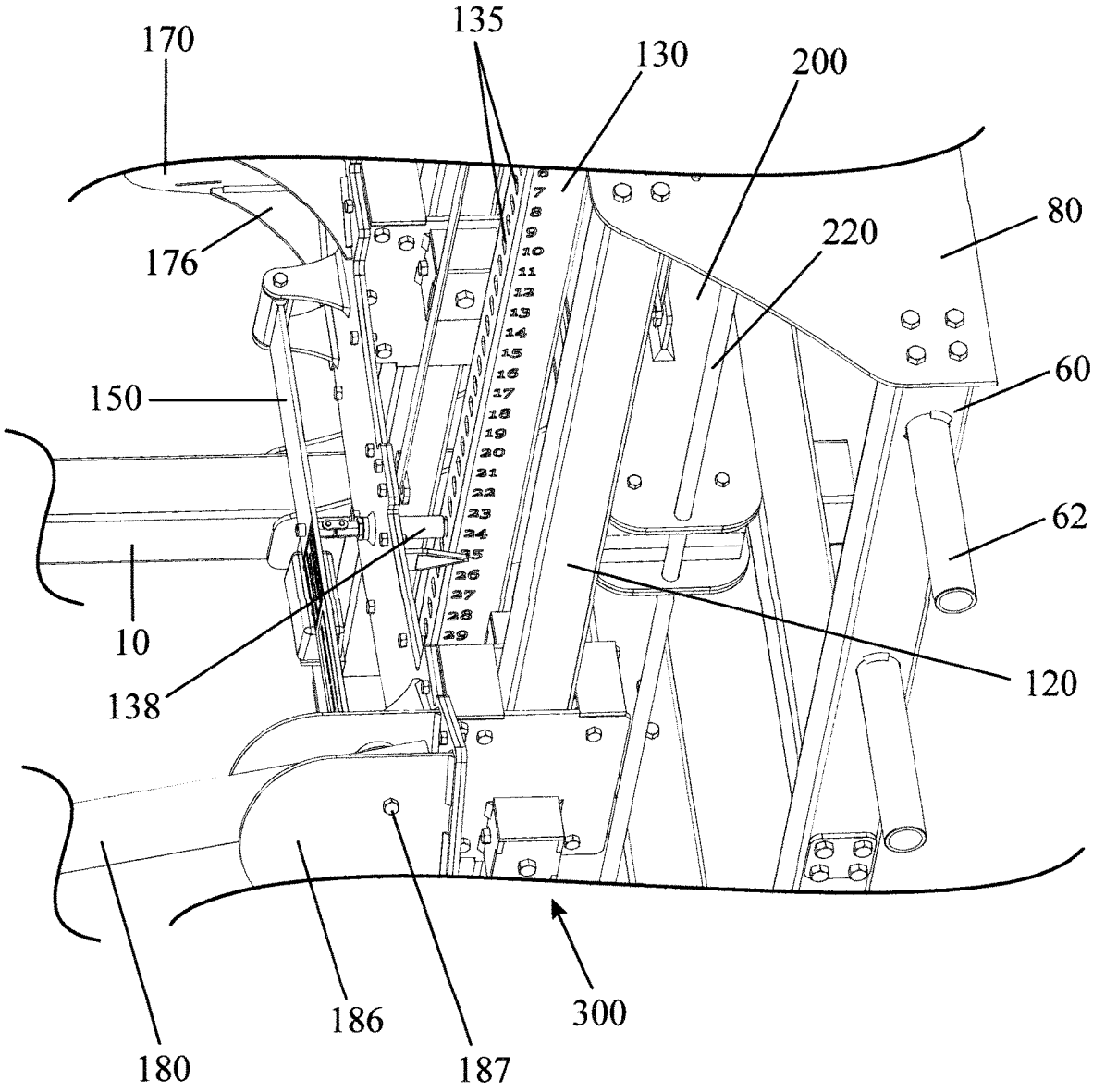
FIG. 12 is an enlarged perspective view of the assembled carriage of FIG. 11 with the assembled fitness machine of FIGS. 1-10.

FIG. 12 is an enlarged perspective view of the assembled carriage of FIG. 11 with the assembled fitness machine 1 of FIGS. 1-10.

Referring to FIGS. 1-12, the moveable carriage assembly 100 can include a main horizontal bracket 150 with a left arm holder pivot bracket 176 fixed to a left end of the bracket 150, and a right arm holder pivot bracket 186 fixed to a right end of the bracket 150.

An inner end of a left inwardly converging pivotal arm 170 can be pivotally attached to the left arm holder pivot bracket 176 by a left pivot pin 177. An inner end of a right inwardly converging pivotal arm 180 can be pivotally attached to the right arm holder pivot bracket 186 by a right pivot pin 187.

The outer end of the left inwardly converging pivotal arm 170 can include an inwardly facing grip 172 and an outwardly extending post 174 for placing weights thereon.

The outer end of the right inwardly converging pivotal arm 180 can include an inwardly facing grip 182, and an outwardly extending post 184. The inwardly converging arms 170 and 180 can be raised up and down by the inwardly facing grips 172, 182, together, or separately. Additional different weight amounts can be placed on the respective outwardly extending posts 174, 184 as desired by the user.

On a left back portion of the main carriage bracket 150 can be a left front cover flange 178 for covering and attaching a front face of a left bearing box 300. On a right back portion of the main carriage bracket 150 can a right front cover flange 188 for covering and attaching to a front face of a right bearing box 300.

Figure 13:
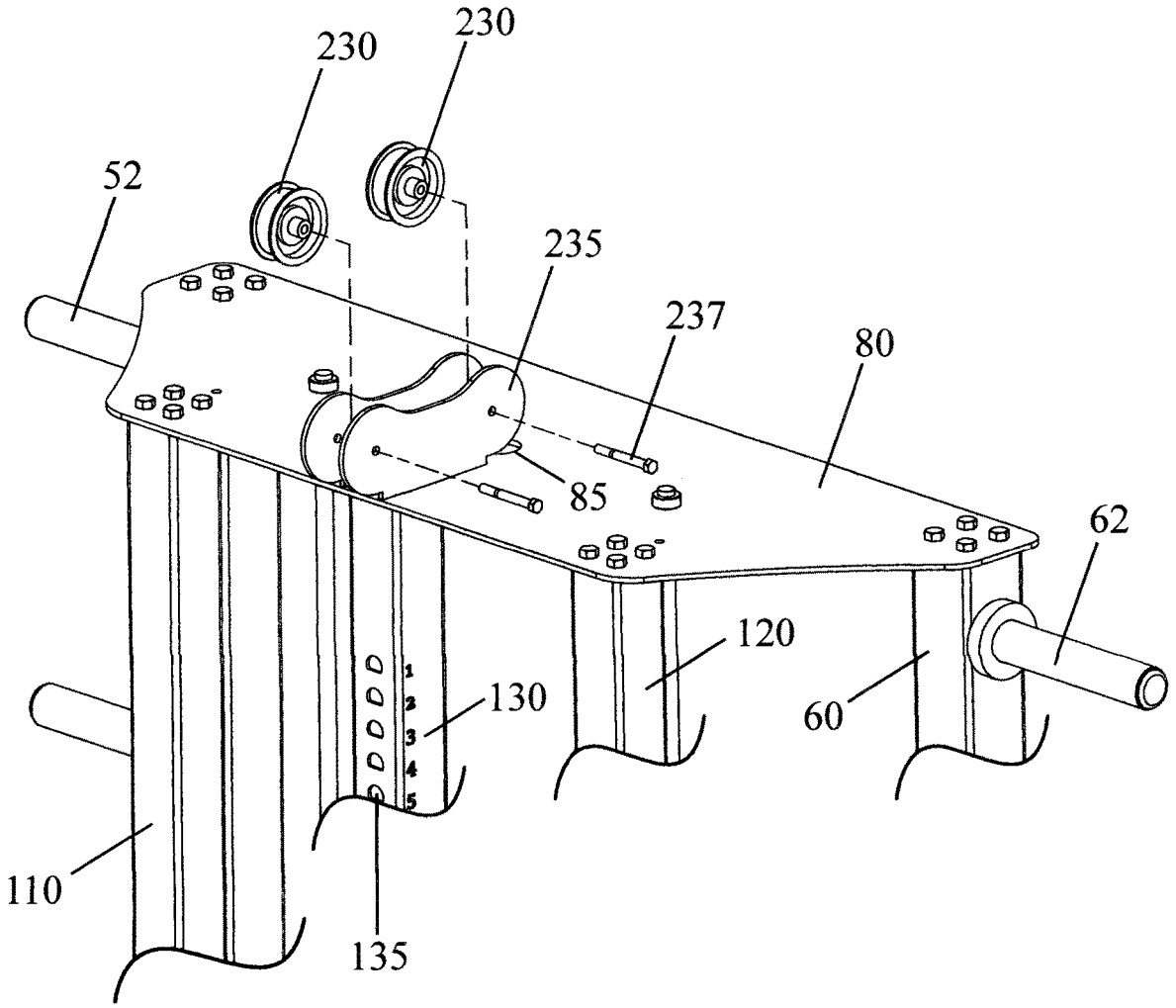
FIG. 13 is an enlarged exploded perspective view of the pulley wheels on the fitness machine of FIGS. 1-10.

FIG. 13 is an enlarged exploded perspective view of the pulley wheels 230 on the fitness machine 1 of FIGS. 1-10.

Figure 14A:
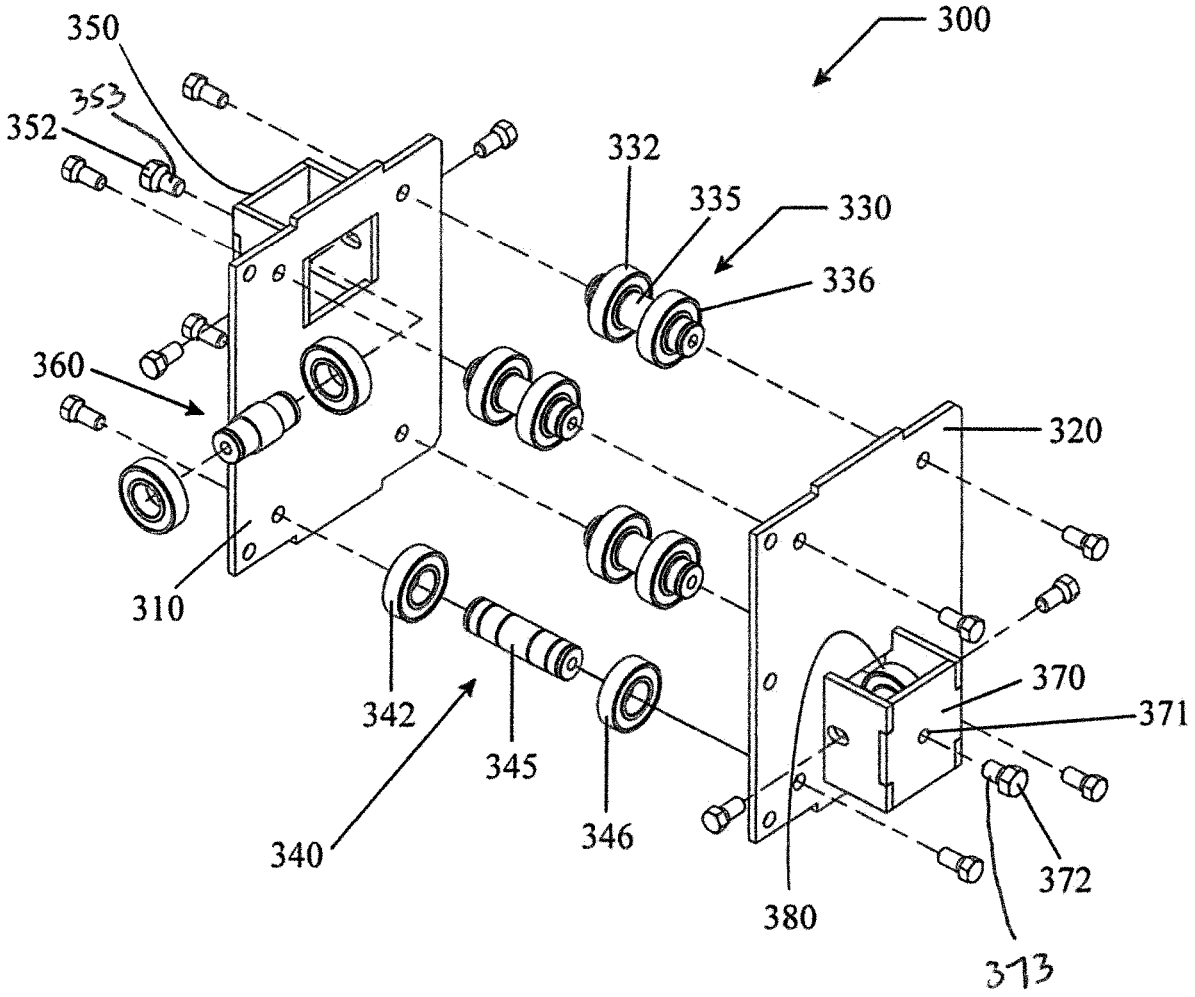
FIG. 14A is an enlarged exploded perspective view of the bearing box on back of the fitness machine of FIGS. 1-10.
Figure 14B:
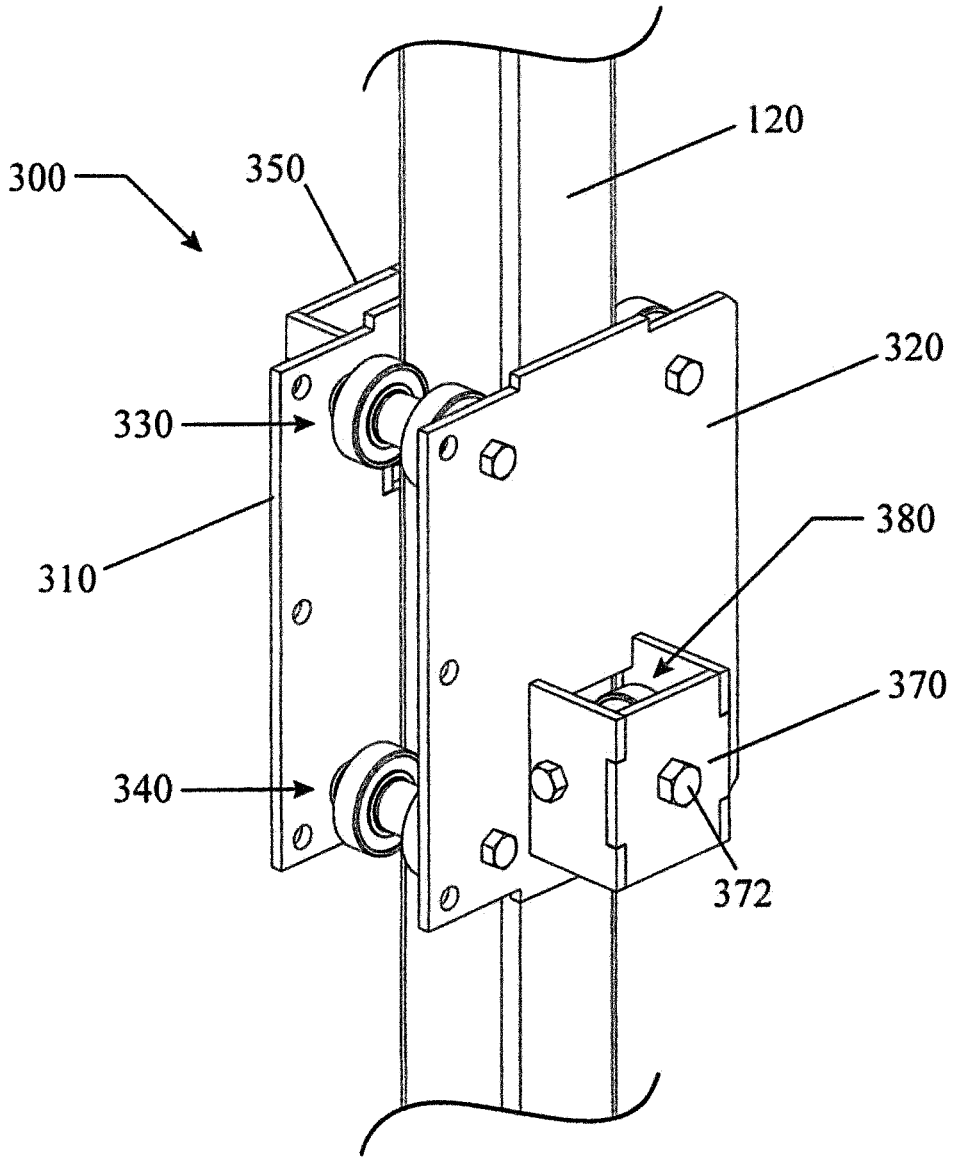
FIG. 14B is an assembled view of the components in the bearing box of FIG. 14A.

FIG. 14A is an enlarged exploded perspective view of the bearing box 300 on back of the fitness machine 1 of FIGS. 1-10. FIG. 14B is an assembled view of the components in the bearing box 300 of FIG. 14A.

Figure 14C:
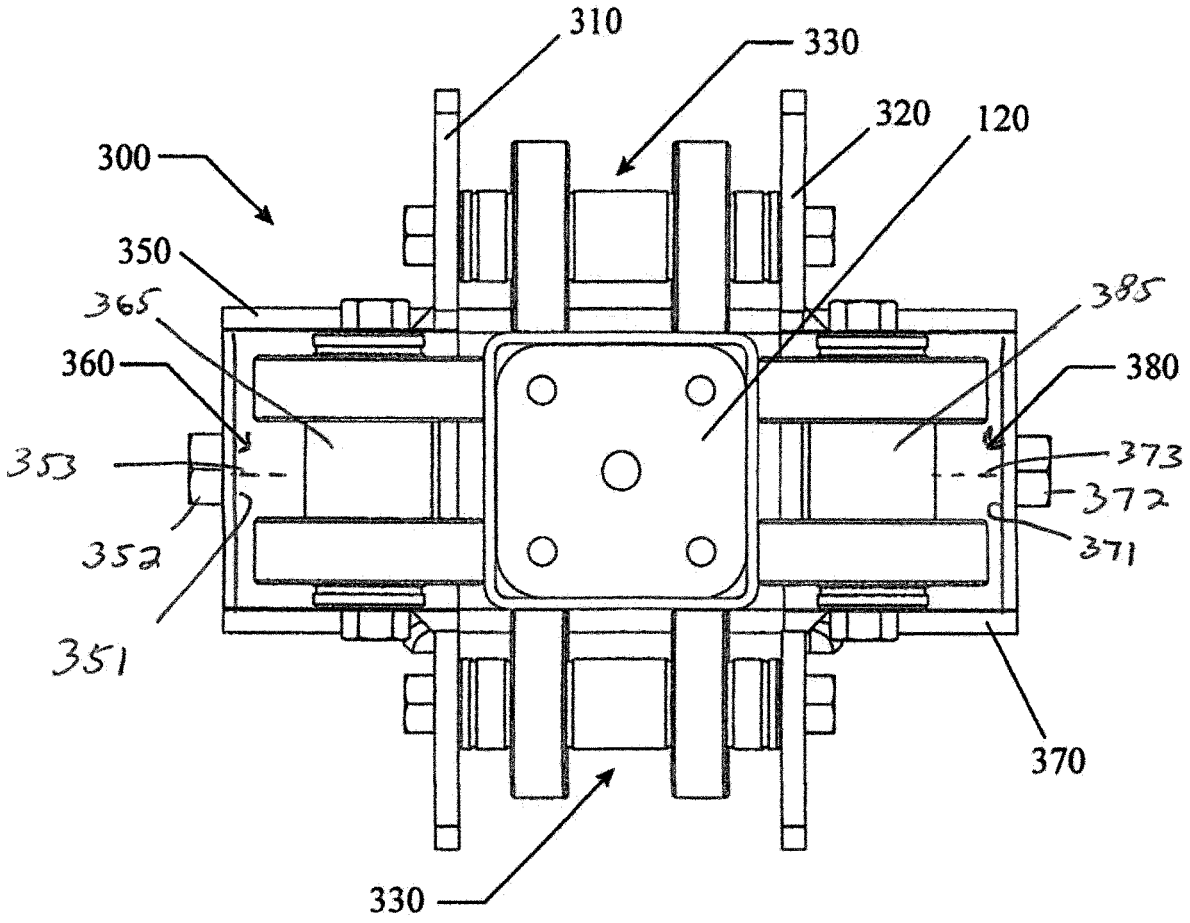
FIG. 14C is a top cross-sectional view of the assembled bearing box of FIG. 14B on the right vertical guide tube.

FIG. 14C is a top cross-sectional view of the assembled bearing box 300 of FIG. 14B on the right vertical guide tube 120.

Referring to FIGS. 1-14C, the bearing box 300 can include two bearing boxes that allow for the carriage assembly 100 to ride up and down on the left vertical carriage guide tube 110, and the right vertical carriage guide tube 120.

Each bearing box 300 can include a left wall panel 310 and a right wall panel 320 spaced apart from another by a top pair of bearings 330 and a bottom pair of bearings 340.

Each of the bearings 330 can be located on a front and rear side of the vertical guide tubes 110, 120 to allow for the carriage assembly 100 to easily roll up and down on the vertical carriage guide tubes 110, 120.

Each bearing 330 can include a first wheel 332 and second wheel 336 that are freely rotatable on a shaft 335. Each of the bearings 340 can be located on a front and rear side of the vertical guide tubes 110, 120 spaced under the top pair of bearings 330. Each bearing 340 can include a first wheel 342 and a second wheel 346 that are freely rotatable on a shaft 345.

Each of the bearing boxes 300 can further include a side bearing box 350 extending outward from the left wall panel 310 and include side bearings 360 inside (similar to the bearings and shaft 330, 340, 345). The side bearings 360 can roll along a left side of the vertical guide tubes 110, 120.

Each of the bearing boxes 300 can further include a side bearing box 370 extending outward from the right wall panel 320 and include side bearings 380 inside (similar to the bearings and shaft 330, 340, 345). The side bearings 380 can roll along a right side of the vertical guide tubes 110, 120.

Each of the bearing boxes 300 can further include a side bearing box 350 extending outward from an upper side of wall panel 310 and include side bearings 360 (similar to bearings and shaft 330, 340, 345) inside side bearing box 350. Side bearing box 350 can also have a hole 351 and securing bolt 352. Securing bolt 352 can have a bolt stem axis 353 extending into the side box that bisects a midportion of the bearing shaft 365 of side bearings 360. The side bearings 360 can roll on an inside edge of vertical guide tubes 110, 120.

Each of the bearing boxes 300 can further include a side bearing box 370 extending outward from a lower side of wall panel 320 and include side bearings 380 (similar to bearings and shaft 330, 340, 345) inside side bearing box 370. Side bearing box 370 can also include a hole 371 and securing bolt 372. Securing bolt 372 can have a bolt stem axis 373 extending into the side box that bisects a midportion of the bearing shaft 385 of side bearings 380. The side bearings 380 can roll on an outer edge of vertical guide tubes 110, 120.

Referring to FIGS. 1-14C, the fitness machine 1 can include a pulley bracket 235 fixably attached on top of the top plate 80. A through-hole 85 can be located in the top plate 80 behind the pulley bracket 235. A pair of pulley wheels 230 can be rotatably mounted in the pulley bracket 235 by pins 237 so the pulley wheels 230 are freely rotatable.

A flexible line 240, such as but not limited to a Kevlar belt, and the like can have one end attached to the top of a counter-weight 200. The flexible line 240 passes through the through-hole 85 in the top plate 80 and over the rotatable pulley wheels 230 and down the front of the machine 1 and is fixably attached to the top of the main carriage bracket 150.

A left counter-weight guide tube 210 can have an upper end fixably attached to a bottom portion of the top plate 80 and a bottom end fixably attached to an upper portion of one of the cross braces 35. A right counter-weight guide tube 220 can have an upper end fixably attached to another bottom portion of the top plate 80 and a bottom end fixably attached to an upper portion of another one of the cross braces 35.

Left guide rod holes 201 on the left side of the counter-weight 200 can allow for the left side of the counter-weight 200 to slide up and down on the left counter-weight guide rod 210. Right guide rod holes 203 on the right side of the counter-weight 200 can allow for the right side of the counter-weight 200 to freely slide up and down on the right counter-weight guide rod 220.

The counter-weight 200 allows for the main bracket 150 and the carriage assembly 100 to be easily raised and lowered by the user. A spring loaded pop pin 138 locks the carriage assembly 100 to any one of the vertically spaced apart selector holes 135 on the vertical height selector tube 130.

Figure 15:
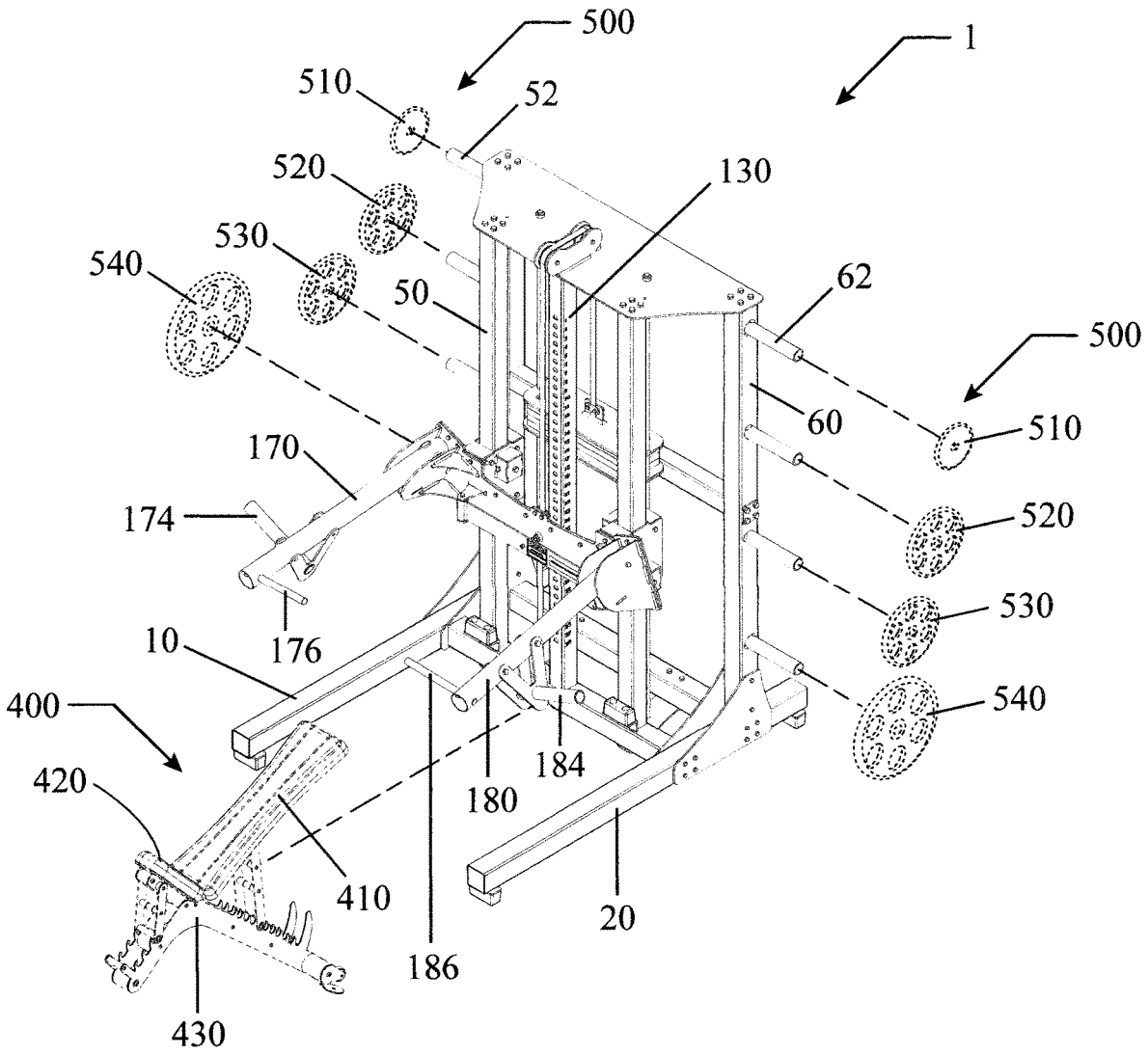
FIG. 15 is another perspective view of the fitness machine of FIG. 1 with weights to be added thereon and adjustable position bench.
Figure 16:
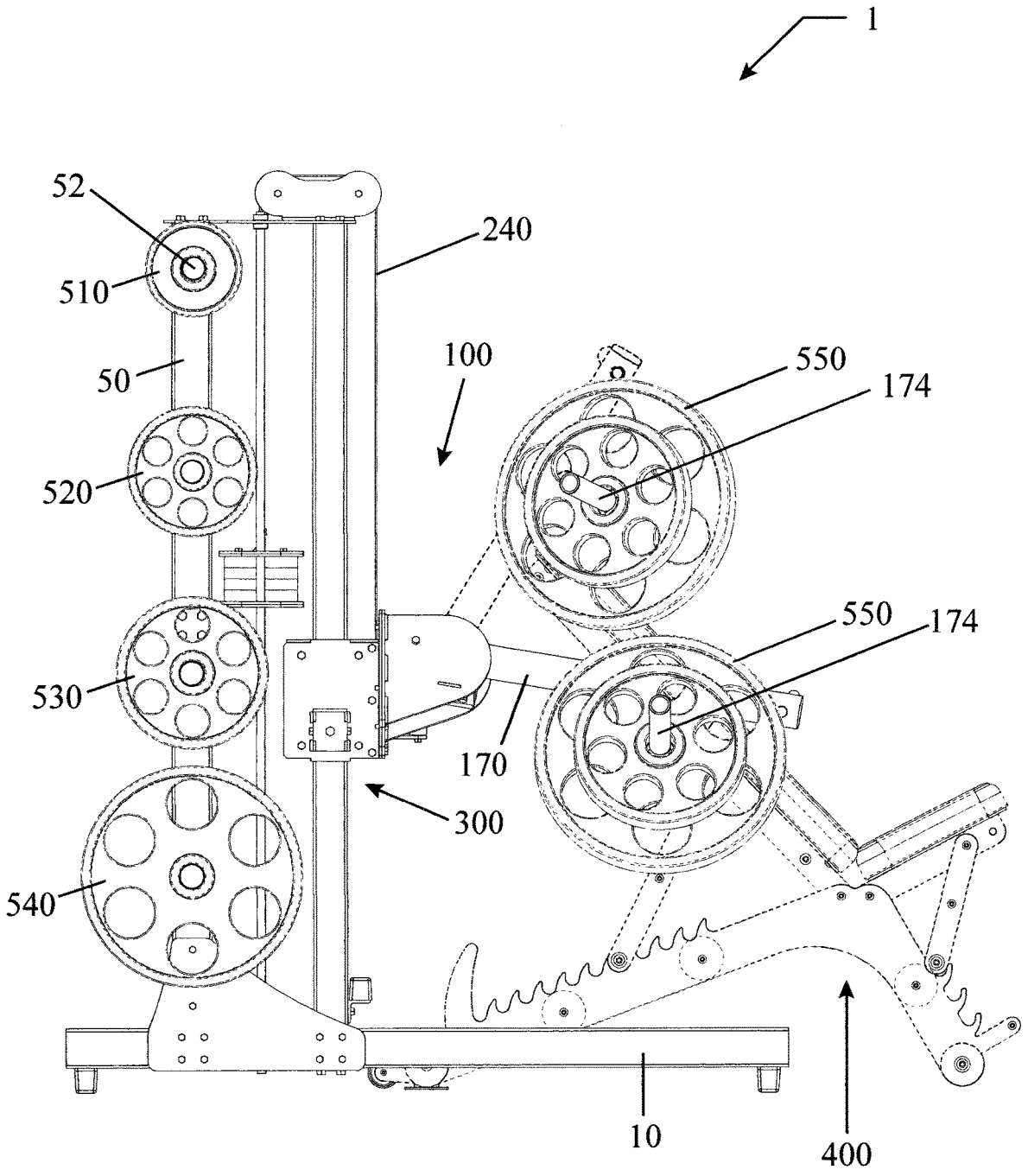
FIG. 16 is a left side view of the fitness machine of FIG. 9 with weights on the machine and arms being moved upward.
Figure 17:
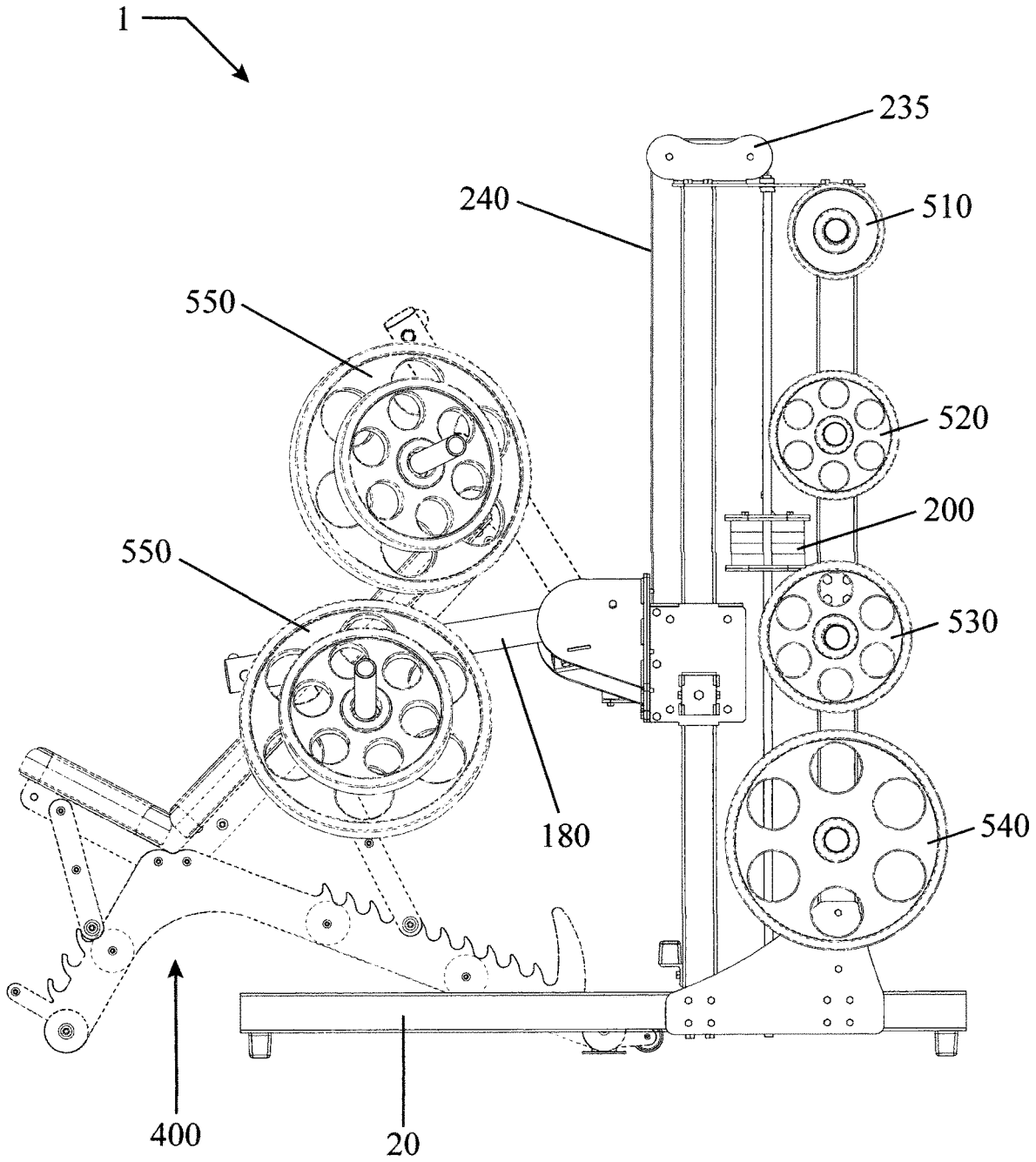
FIG. 17 is a right side view of the fitness machine of FIG. 9 with weights on the machine and arms being moved upward.

FIG. 15 is another perspective view of the fitness machine 1 of FIG. 1 with weights 500 to be added thereon and adjustable position bench 400. FIG. 16 is a left side view of the fitness machine 1 of FIG. 9 with weights 510, 520, 530, 540 and 550 on the machine 1 and arms 170, 180 being moved upward. FIG. 17 is a right side view of the fitness machine 1 of FIG. 9 with weights 510, 520, 530, 540 and 550 on the machine 1 and arms 170, 180 being moved upward.

Figure 18:
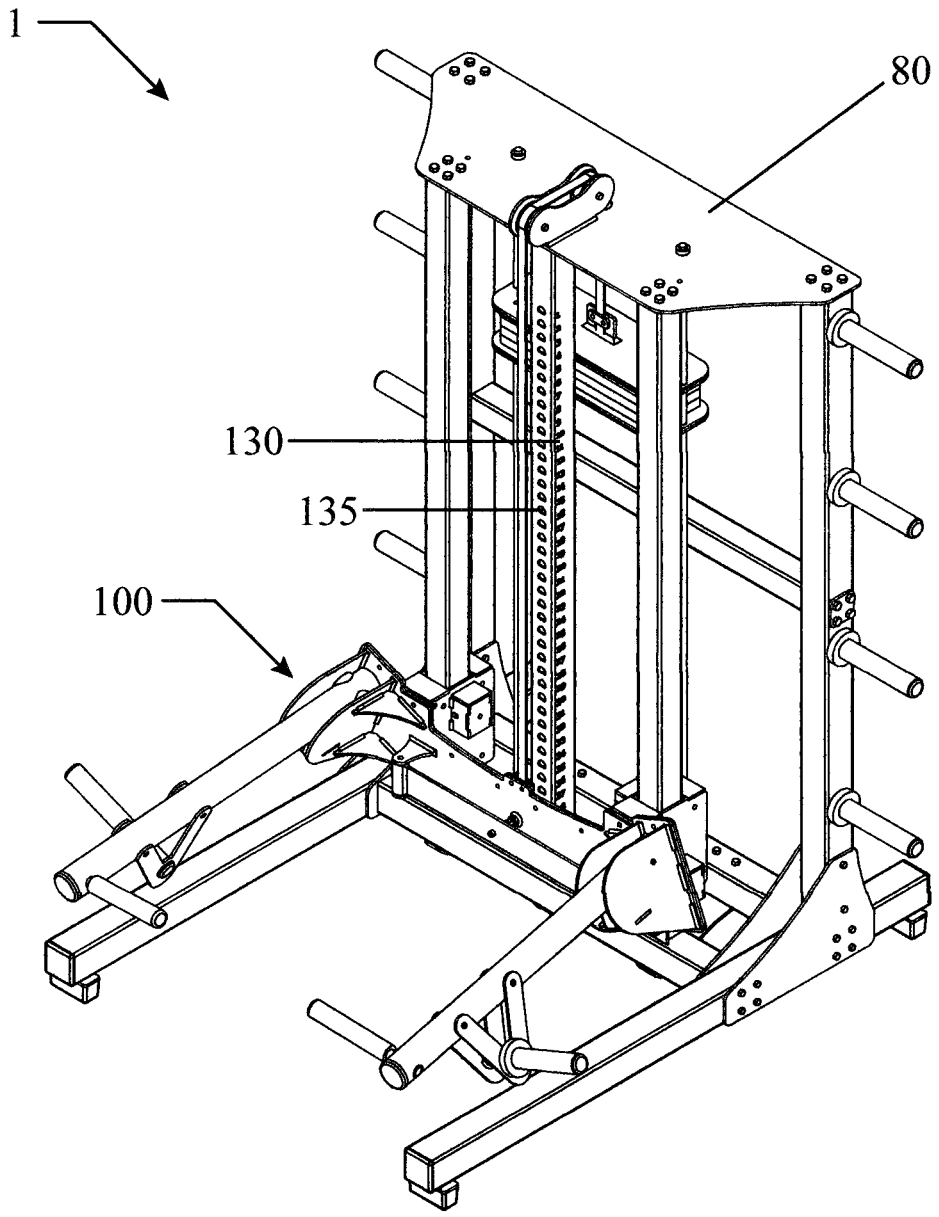
FIG. 18 is another upper right perspective view of the fitness machine with carriage and converging arms at a lowest position.

FIG. 18 is another upper right perspective view of the fitness machine 1 with carriage 100 and converging arms 170, 180 at a lowest position.

Figure 19:
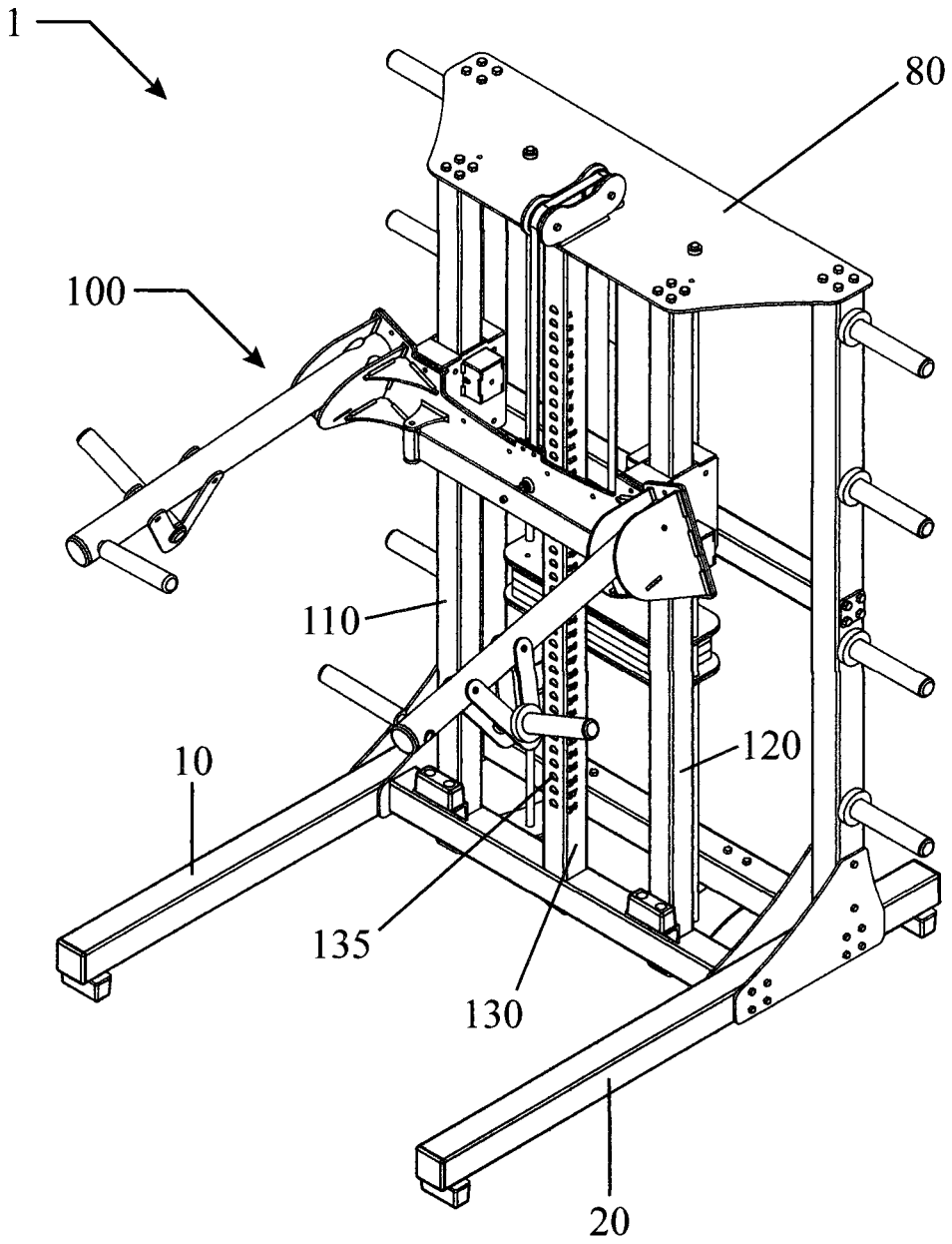
FIG. 19 is another upper right perspective view of the fitness machine with carriage and converging arms raised to an upper position.

FIG. 19 is another upper right perspective view of the fitness machine 1 with carriage 100 and converging arms 170, 180 raised to an upper position.

Figure 20:
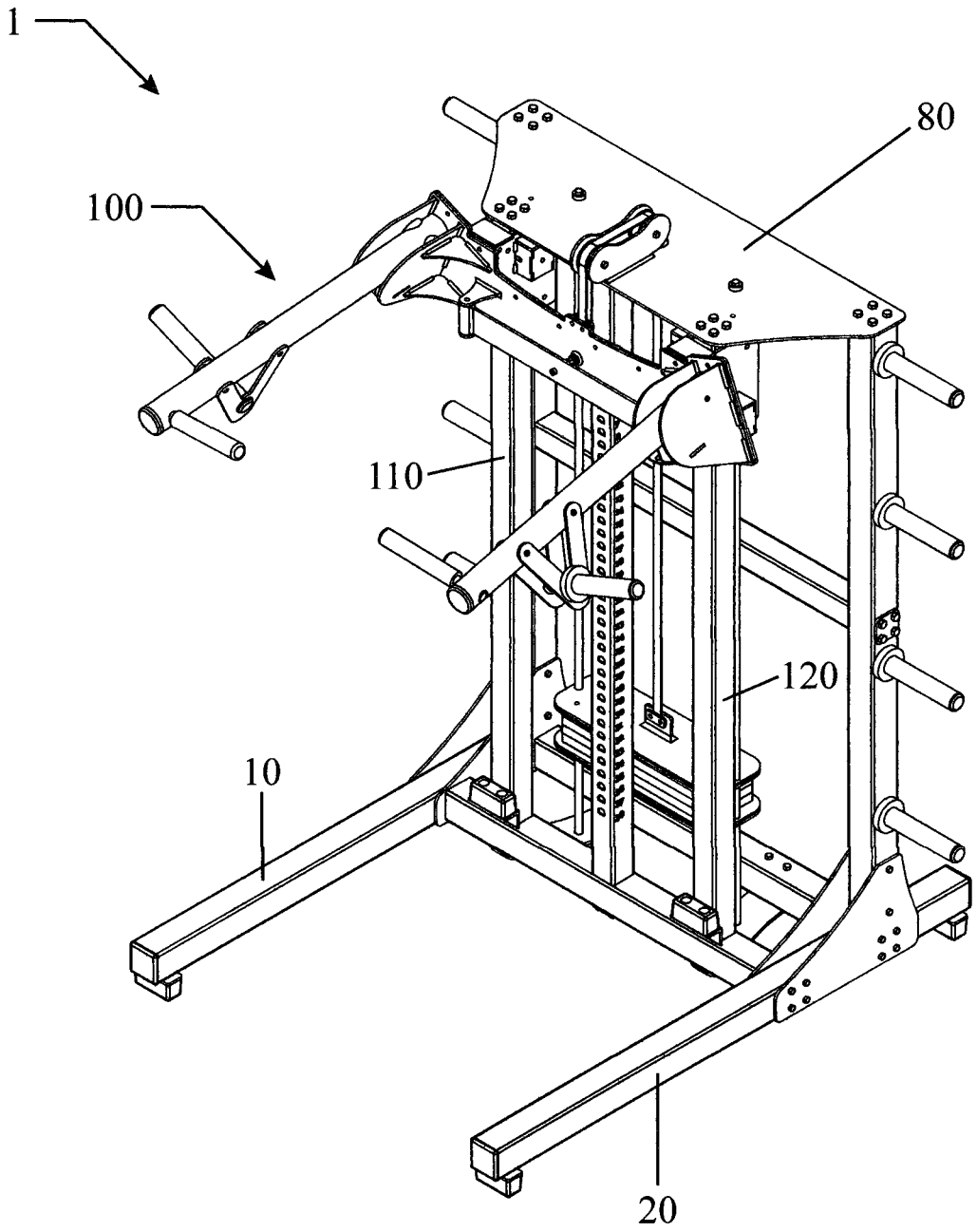
FIG. 20 is another upper right perspective view of the fitness machine with carriage and converging arms raised to an uppermost position.

FIG. 20 is another upper right perspective view of the fitness machine 1 with carriage 100 and converging arms 170, 180 raised to an uppermost position.

Referring to FIGS. 1-20, the user can store free weights 500 having different weight sizes 510, 520, 530, 540 on the left weight storage posts 52 and right weight storage posts 62.

When the user is ready to use the machine, selected free weights 550 can be positioned on the left outwardly extending post 174 on converging arm 170 and on the right outwardly extending post 184 on the converging arms 180.

A bench 400 can have an adjustable back 410 and an adjustable seat 420 that can be placed in front of the adjustable carriage 100. This can allow for a number of varying exercises to be performed depending on the height of the carriage system 100 relative to the vertical height adjuster tube 130, and the adjustment of the bench 400.

The novel invention allows for the converging arms 170, 180 of plate loaded weight to be adjusted for height to perform varying exercises.

While a bench 400 is shown other types of seats can be used. The bench and/or seat can also be bolted into the machine 1 in a fixed position. This allows for no exercise variation for plate loaded exercise equipment. The benches and seats can also be free standing as desired by the user.

The novel invention allows for the user to lift either or both converging arms 170, 180 separately or together with the same weight or different free weights on the pivoting arms the respective weight posts 174, 184.

The vertical height selector tube 130 allows for the user to adjust the carriage 100 and pivotal press arms 170, 180 to the desired height to perform the desired exercise.

When the arms 170, 180 are pushed upward they move together in a fixed converging angle. The higher the arms 170, 180 are lifted the closer they become. When the arms 170, 180 are lowered to the starting position they diverge or move apart. The arms 170, 180 rotate upward when pushed via the arm bearing system 177, 187 which acts as a rotation point and is attached to the adjustable carriage system by way of a bearing shaft and bolts.

While the preferred embodiment describes, parts of the frame 5 are described as fixably attached to one another, this term can include but is not limited to parts bolted together, screwed together, welded together and any combination thereof.

What makes the fitness machine 1 unique is that the converging arms 170, 180 are fully adjustable for height to perform a wide variety of exercises. This is accomplished through the adjustable arm carriage assembly 100 and the ability to use any adjustable bench 400 within the unit.

Another unique feature of fitness machine 1 is the ability to limit the range of motion of the desired exercise being performed.

With the adjustable carriage assembly 100 and the pivotal converging arms, the depth of the exercise movement can be controlled by adjusting the carriage 100 to limit the motion of the desired exercise. This feature is very important for injury prevention and/or injury rehabilitation or for doing partial repetitions to help gain additional strength before transitioning into a full range of motion.

The height adjustability of the carriage 100 containing the independent converging press arms 170, 180 and the ability to use a bench 400 with and adjustable seat bottom 420 and seat back 410 to perform varying exercises on the unit are what makes it unique to the industry.

Although specific advantages have been enumerated above, various embodiments may include some, none, or all of the enumerated advantages.

Other technical advantages may become readily apparent to one of ordinary skill in the art after review of the following figures and descriptions.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise specifically noted, articles depicted in the drawings are not necessarily drawn to scale.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A weight press exercise system, comprising:

a frame having a front side and a rear side;

a front pair of vertical members attached to the frame, adjacent to the front side of the frame, each of the front vertical members being parallel to each another, each of the front vertical members having an upper end and a lower end;

a carriage for sliding up and down on the front pair of vertical members;

a pair of spaced apart pivotal arms, each having an inner end for being pivotally attached to the carriage, and a grip adjacent an outer end of each of the arms;

a weight support post adjacent each outer end of the pivotal arms, each weight support post for allowing different amounts of weights to be positioned thereon; and an adjustable mount for prepositioning the carriage to be at different fixed height levels between the lower end and the upper end of the vertical members, wherein the grips on the pivotal arms are adapted to be gripped by a user positioned between the pivotal arms in order to push up and down to perform exercises based on different ranges of motion of the carriage based on the initial fixed position of the carriage; and a center post between the front pair of vertical members; and a fastening member for attaching the carriage to the center post.

2. A weight press exercise system, comprising:

a frame having a front side and a rear side;

a front pair of vertical members attached to the frame, adjacent to the front side of the frame, each of the front vertical members being parallel to each another, each of the front vertical members having an upper end and a lower end;

a carriage for sliding up and down on the front pair of vertical members;

a pair of spaced apart pivotal arms, each having an inner end for being pivotally attached to the carriage, and a grip adjacent an outer end of each of the arms;

a weight support post adjacent each outer end of the pivotal arms, each weight support post for allowing different amounts of weights to be positioned thereon; and an adjustable mount for prepositioning the carriage to be at different fixed height levels between the lower end and the upper end of the vertical members, wherein the grips on the pivotal arms are adapted to be gripped by a user positioned between the pivotal arms in order to push up and down to perform exercises based on different ranges of motion of the carriage based on the initial fixed position of the carriage, and wherein the adjustable mount includes:

a vertical height adjustment post having a plurality of vertically spaced apart openings; and a pin for locking the carriage to a selected one of the vertically spaced apart openings on the vertical post.

3. A weight press exercise system, comprising:

a frame having a front side and a rear side;

a front pair of vertical members attached to the frame, adjacent to the front side of the frame, each of the front vertical members being parallel to each another, each of the front vertical members having an upper end and a lower end;

a carriage for sliding up and down on the front pair of vertical members;

a pair of spaced apart pivotal arms, each having an inner end for being pivotally attached to the carriage, and a grip adjacent an outer end of each of the arms;

a weight support post adjacent each outer end of the pivotal arms, each weight support post for allowing different amounts of weights to be positioned thereon; and an adjustable mount for prepositioning the carriage to be at different fixed height levels between the lower end and the upper end of the vertical members, wherein the grips on the pivotal arms are adapted to be gripped by a user positioned between the pivotal arms in order to push up and down to perform exercises based on different ranges of motion of the carriage based on the initial fixed position of the carriage; and a pulley on top of the frame;

a counter-weight; and a flexible line having a first end attached to the carriage and a second end passing on the pulley and attached to the counter-weight, wherein the counter-weight allows for the carriage to be positioned to a selected vertical height position.

4. The weight press exercise system of claim 3, wherein the flexible line includes: a flexible belt.

5. The weight press exercise system of claim 3, further comprising:

a pair of vertical guide tubes attached to the frame, wherein side holes in the counter-weight allow for the counter-weight to slide up and down when the carriage is being positioned to the selected vertical height position.

6. A weight press exercise system, comprising:

a frame having a front side and a rear side;

a front pair of vertical members attached to the frame, adjacent to the front side of the frame, each of the front vertical members being parallel to each another, each of the front vertical members having an upper end and a lower end;

a carriage for sliding up and down on the front pair of vertical members;

a pair of spaced apart pivotal arms, each having an inner end for being pivotally attached to the carriage, and a grip adjacent an outer end of each of the arms;

a weight support post adjacent each outer end of the pivotal arms, each weight support post for allowing different amounts of weights to be positioned thereon; and an adjustable mount for prepositioning the carriage to be at different fixed height levels between the lower end and the upper end of the vertical members, wherein the grips on the pivotal arms are adapted to be gripped by a user positioned between the pivotal arms in order to push up and down to perform exercises based on different ranges of motion of the carriage based on the initial fixed position of the carriage;

a bearing assembly attached to the carriage for allowing the carriage to slide up and down on the front pair of vertical members, wherein the bearing assembly includes:

front side bearings for allowing the carriage to ride up and down on a front side of each of the vertical members;

rear side bearings for allowing the carriage to ride up and down on a rear side of each of the vertical members;

left side bearings for allowing the carriage to ride up and down on a left side of each of the vertical members;

right side bearings for allowing the carriage to ride up and down on a right side of each of the vertical members; and securing members for the left side bearings and the right side bearings, the securing members include bolts each having bolt stem axes that bisects a midportion of a bearing shaft of each of the left side bearings and the right side bearings, wherein the left side bearings and the right side bearings roll on outer sides of the vertical members.

7. The weight press exercise system of claim 6, wherein the pivotal arms have an initial horizontal position.

8. The weight press exercise system of claim 6, wherein the pivotal arms converge together when moved upward.

9. The weight press exercise system of claim 8, wherein the grip on each of the arms extend inward toward each other.

10. The weight press exercise system of claim 8, wherein the weight support post on each of the arms extend outward from the pivoting arms.

11. The weight press exercise system of claim 9, wherein the weight support post on each of the arms extend outward from the pivoting arms.

12. The weight press exercise system of claim 6, wherein the pivotal arms are independently moveable from one another.

13. The weight press exercise system of claim 6, further comprising:

an adjustable bench not attached to the front side of the frame, the adjustable bench being adjustable to different positions spaced from the frame.

14. The weight press exercise system of claim 13, wherein the adjustable bench includes:

an adjustable seat portion; and an adjustable back portion attached to the adjustable seat portion.

15. The weight press exercise system of claim 14, wherein the adjustable bench includes:

an inverted L-shape stand, on which the seat portion and the back portion are located.

16. The weight press exercise system of claim 6, further comprising:

a pair of vertical posts adjacent to the rear side of the frame, each of the vertical posts having a plurality of side extending posts, wherein the side extending posts are configured to support and store free weights thereon.

17. The weight press exercise system of claim 6, wherein the bearing assembly includes:

rotatable wheels on axles for allowing the carriage to ride up and down on each of the vertical members.

* * * * *